US006467440B1

(12) United States Patent
Kozulin et al.

(10) Patent No.: US 6,467,440 B1
(45) Date of Patent: Oct. 22, 2002

(54) TWO STROKE INTERNAL COMBUSTION ENGINE

(76) Inventors: Vladimir B. Kozulin, 8 New Bellamy La., Dover, NH (US) 03820; Boris P. Chopovski, ul. Sheinkmana, 19, kv. 8, Ekaterinburg 620077 (RU); Nikolai V. Kozulin, 8 New Bellamy La., Dover, NH (US) 03820

( * ) Notice: Subject to any disclaimer, the term of this patent is extended or adjusted under 35 U.S.C. 154(b) by 0 days.

(21) Appl. No.: 09/339,320

(22) Filed: Jun. 23, 1999

(30) Foreign Application Priority Data

Jun. 22, 1998 (RU) ..... 98111885

(51) Int. Cl.[7] ..... F02B 33/44; F02B 33/12; F02B 75/32

(52) U.S. Cl. ..... 123/61 R; 123/70 R; 123/51 B

(58) Field of Search ..... 123/51 B, 52.2, 123/61 R, 70 R, 70 V, 65 A, 65 B, 65 BA, 71 R

(56) References Cited

U.S. PATENT DOCUMENTS 896,514 A * 8/1908 Brundige ..... 123/51 B
968,636 A * 8/1910 Aslakson ..... 123/61 R
973,268 A * 10/1910 Fogg ..... 123/61 R
1,471,847 A * 10/1923 Holliday ..... 123/51 B
2,706,970 A * 4/1955 Rinne ..... 123/51 B
4,079,705 A * 3/1978 Buchner ..... 123/51 B
4,157,080 A * 6/1979 Hill ..... 123/51 B
4,275,689 A * 6/1981 Ray ..... 123/51 B
4,312,308 A * 1/1982 Slattery ..... 123/65 A
4,516,539 A * 5/1985 Andreen ..... 123/51 B
4,781,155 A * 11/1988 Brucker ..... 123/70 V
5,638,779 A * 6/1997 Atmur et al. ..... 123/65 BA
5,862,781 A * 1/1999 Rossle ..... 123/55.7

* cited by examiner

*Primary Examiner*—Tony M. Argenbright
*Assistant Examiner*—Hai Huynh

(57) ABSTRACT

A two stroke internal combustion engine, comprising one or more power cylinders with intake and exhaust ports and a source of scavenging of the power cylinders, with improvements, including use of double-sided cylinders with upper and lower cavities used as power or pumping cavities connected to each other in different combinations.

1 Claim, 28 Drawing Sheets

A-A

TWO STROKE INTERNAL COMBUSTION ENGINE

CROSS-REFERENCE TO RELATED PATENTS AND APPLICATIONS

Two Stroke Internal Combustion Engine. Patent of Russian Federation No. 2143077, Int. Cl. F02 B 33/00, registered Dec. 20, 1999, published in 1999, Bul. No 35, priority date Jun. 22, 1998, application No 98111885/06.

REFERENCES CITED

1. Two Stroke Internal Combustion Engine. RU Patent No. 2063524, Int. Cl. F02 B 33/22, published in 1996, Bul. No. 19.
2. Two Stroke Internal Combustion Engine. U.S. Pat. No. 2,522,649, US Cl. 123–70, 1950.
3. Radial Two Stroke Internal Combustion Engine with Piston Scavenging Pumps. SU Patent No. 54112, Int. Cl. F02 B 33/22, 75–22, 1939.

INFORMATION SOURCES, TAKEN INTO CONSIDERATION

1. RU Patent No. 2063524 Cl, Jul. 10, 1996
2. U.S. Pat. No. 2,522,649 A, Sep. 19, 1950
3. SU Patent No. 54112 A, Feb. 28, 1939
4. SU Patent No. 2472 A, Mar. 31, 1927
5. U.S. Pat. No. 3,880,126 A, Apr. 29, 1975
6. U.S. Pat. No. 5,265,564 A, Nov. 30, 1993
7. GB Patent No. 994371 A, Nov. 7, 1961

BACKGROUND OF THE INVENTION

This invention relates to further development of two stroke internal combustion engines (from hereinafter referred to as 'TSICE'), which have one or more power cylinders with intake and exhaust ports, and a source of scavenging of the power cylinders.

Some terms and abbreviations used in the following description of previous art and present invention are defined below.

Pistons of TSICE move reciprocally within two limits, conventionally named as 'top dead center' and 'bottom dead center'. From hereinafter top dead center is referred to as 'TDC' and bottom dead center as 'BDC'.

Cavity of a cylinder, which is a space within the walls of the cylinder limited by a face of a piston, from hereinafter is referred to as 'cavity'.

In a double-sided cylinder, a piston has two faces, front and rear, which form two cavities within the walls of the cylinder on the opposite sides of the piston. In further description, due to the upright position of the cylinders on the drawings, the said cavities are referred to as 'upper cavity' and 'lower cavity'.

The main problems, known as deficiencies of TSICE, are the partial mixing of burned gases with the fresh air-fuel mixture, and the loss of some fresh air-fuel mixture through the exhaust ports at the time of scavenging.

As long as improvements can be achieved, reducing these problems, there is a chance to increase power per liter of displacement.

The so-called direct-flow scavenging/charging of the power cylinders has to be organized, when fresh air-fuel mixture fills up the cavity of the power cylinder starting from the intake port towards the exhaust port, so that burned gases always remain in the way of the air-fuel mixture to the exhaust port with minimum mixing.

One of the ways to achieve direct-flow scavenging/charging is to have two power cylinders, connected to each other with a common combustion chamber, where one of the cylinders has an intake port, and another has the exhaust port, as it is in RU Patent No. 2,063,524. Scavenging/charging starts in one cylinder and ends in the other, most importantly, cleaning the area of combustion chamber of burned gases and providing unidirectional displacement of burned gases with fresh air-fuel mixture.

TSICE, according to RU Patent No. 2,063,524, uses a pumping cylinder as a source of scavenging/charging of power cylinders. It comprises the first power cylinder with an intake port, connected to a pumping cylinder, and the second power cylinder with an exhaust port, said cylinders having a common combustion chamber and pistons connected each to its own crank, with the crank of the second piston having advanced crank angle against the crank of the first piston, enabling advanced opening and closing of the exhaust port in relation to the intake port.

Use of an additional cylinder, piston and crank solely for the purpose of scavenging/charging of another cylinder, increases the size and weight of the engine and reduces power per liter of displacement, and should be considered a drawback of the above named patent.

According to the totality of distinctive characteristics, the engine construction of RU Patent No. 2,063,524 is considered the closest prototype of present invention.

BRIEF SUMMARY OF THE INVENTION

Presented is TSICE, which has double-sided cylinders with upper and lower cavities used as power or pumping cavities, connected to each other in different combinations, which reduces the number of cranks and pistons and size and weight of the engine and increases power per liter of displacement.

REFERENCE NUMERALS IN DRAWINGS

Figure 1:
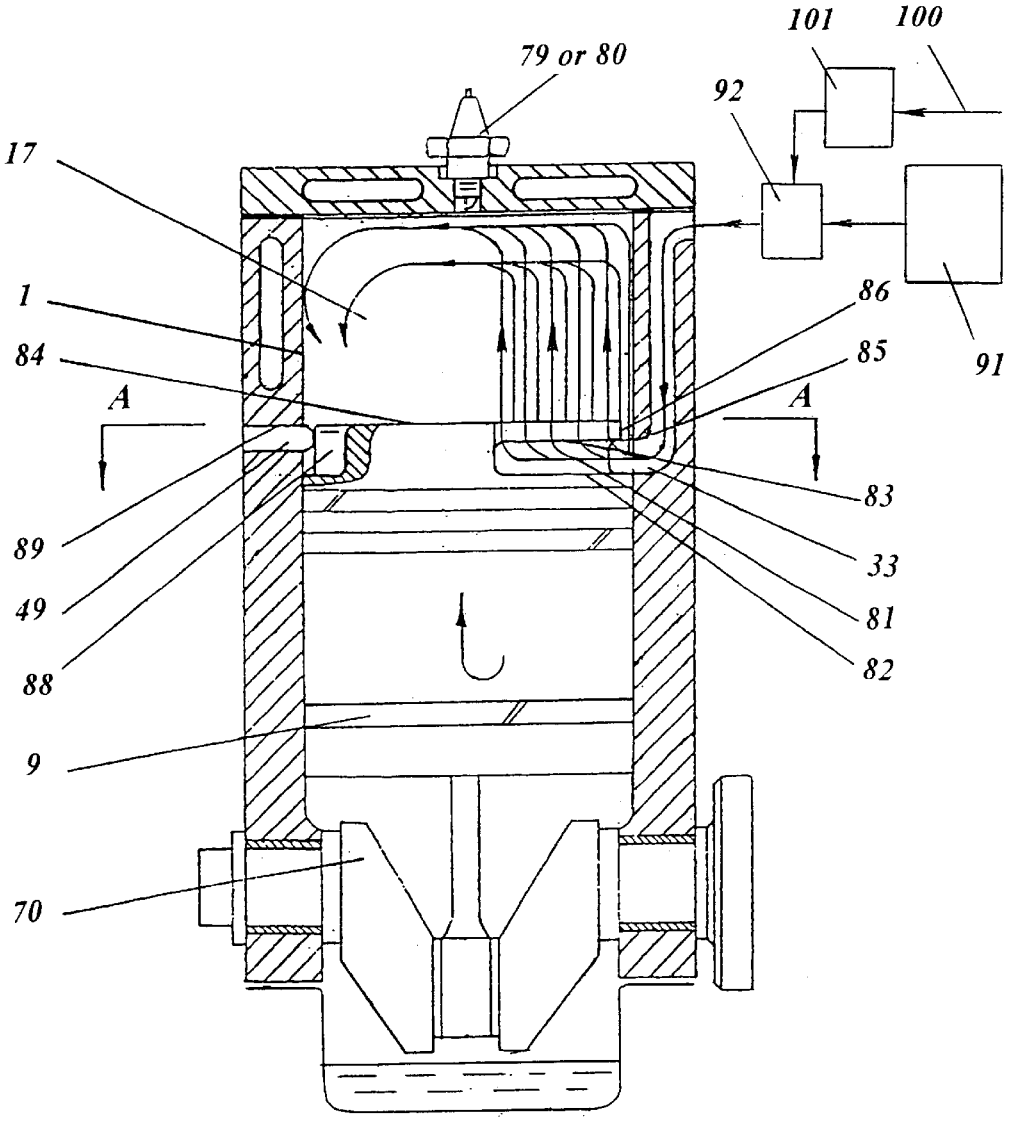
FIG. 1 shows one-cylinder TSICE at the end of the power stroke during scavenging/charging with piston having a baffle.
Figure 2:
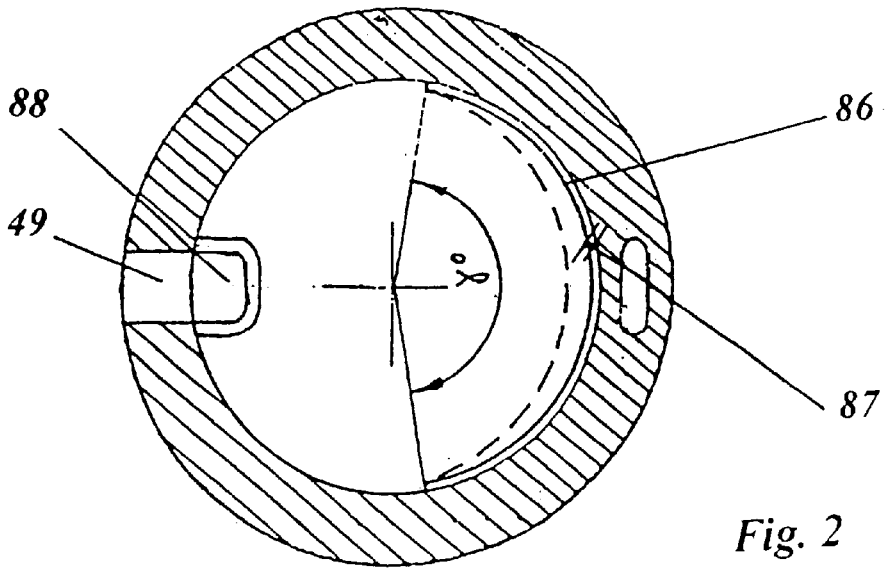
FIG. 2 shows cross section with a top view of the piston illustrating construction of the baffle, forming the gas flow.
Figure 3:
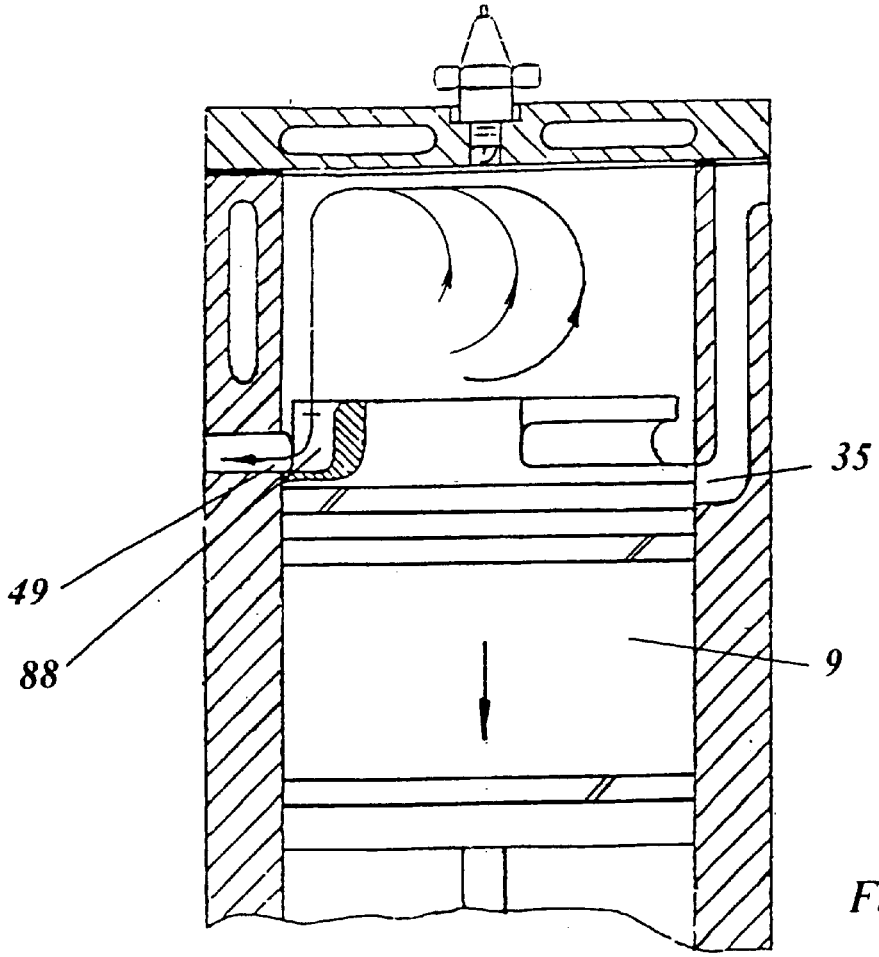
FIG. 3 shows position of a piston at the moment of exhaust of burned gases from power cylinder before the beginning of scavenging, when the intake port is still closed.
Figure 4:
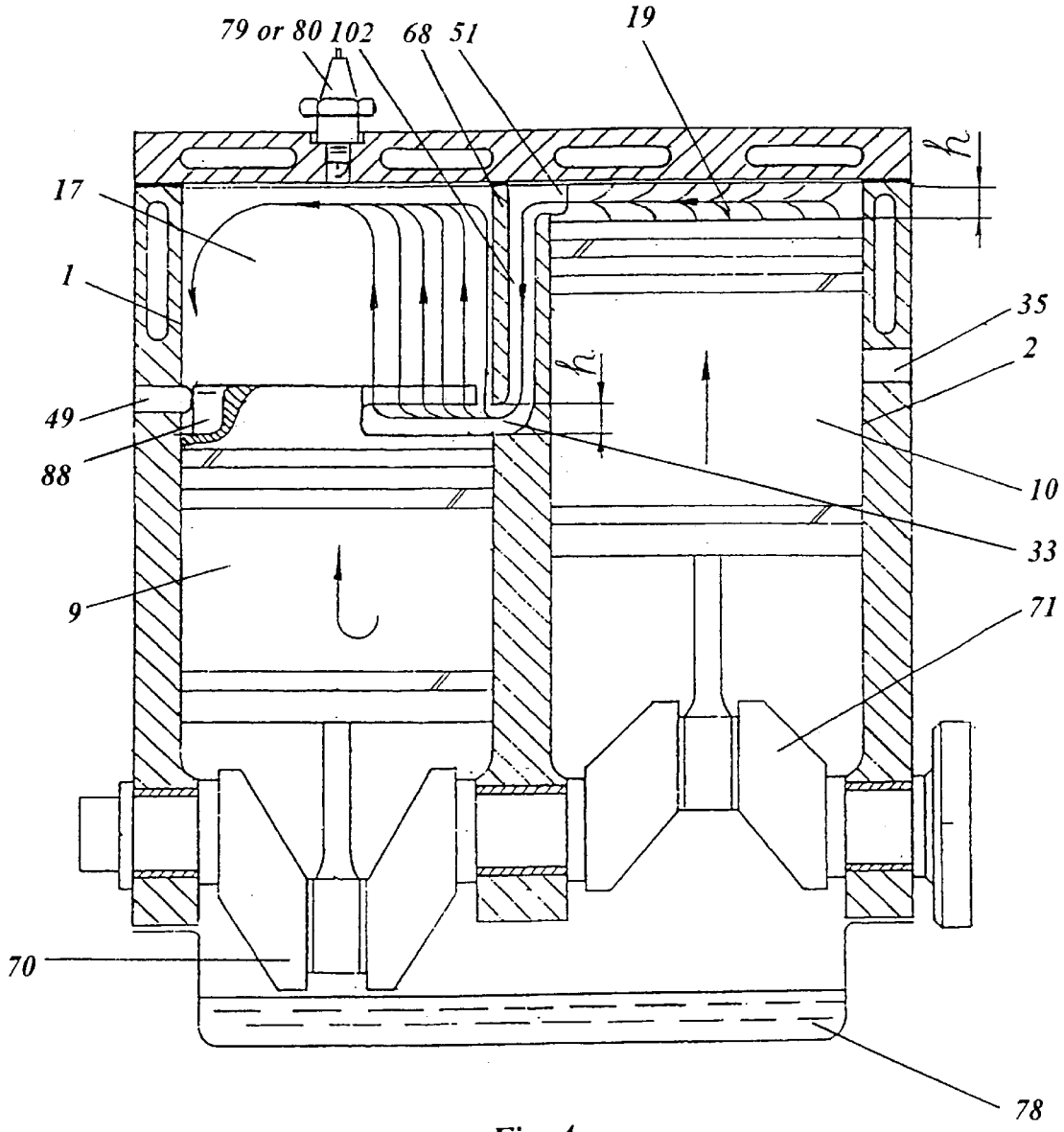
FIG. 4 shows TSICE with pumping cylinder used for scavenging/charging of the power cylinder, with piston of the power cylinder having a baffle.

1 First cylinder of the first bank
2 Second cylinder of the first bank
3 Third cylinder of the first bank
4 Fourth cylinder of the first bank
5 First cylinder of the second bank
6 Second cylinder of the second bank
7 Third cylinder of the second bank
8 Forth cylinder of the second bank
9 Piston of cylinder 1
10 Piston of cylinder 2
11 Piston of cylinder 3
12 Piston of cylinder 4
13 Piston of cylinder 5
14 Piston of cylinder 6
15 Piston of cylinder 7
16 Piston of cylinder 8
17 Upper cavity of cylinder 1

-continued

18 Lower cavity of cylinder 1
19 Upper cavity of cylinder 2
20 Lower cavity ot cylinder 2
21 Upper cavity of cylinder 3
22 Lower cavity of cylinder 3
23 Upper cavity of cylinder 4
24 Lower cavity of cylinder 4
25 Upper cavity of cylinder 5
26 Lower cavity of cylinder 5
27 Upper cavity of cylinder 6
28 Lower cavity of cylinder 6
29 Upper cavity of cylinder 7
30 Lower cavity of cylinder 7
31 Upper cavity of cylinder 8
32 Lower cavity of cylinder 8
33 Intake port of cavity 17
34 Intake port of cavity 18
35 Intake port of cavity 19
36 Intake port of cavity 20
37 Intake port of cavity 21
38 Intake port of cavity 22
39 Intake port of cavity 23
40 Intake port of cavity 24
41 Intake port of cavity 25
42 Intake port of cavity 26
43 Intake port of cavity 27
44 Intake port of cavity 28
45 Intake port of cavity 29
46 Intake port of cavity 30
47 Intake port of cavity 31
48 Intake port of cavity 32
49 Exhaust port of cavity 17
50 Exhaust port of cavity 18
51 Exhaust port of cavity 19
52 Exhaust port of cavity 20
53 Exhaust port of cavity 21
54 Exhaust port of cavity 22
55 Exhaust port of cavity 23
56 Exhaust port of cavity 24
57 Exhaust port of cavity 25
58 Exhaust port of cavity 26
59 Exhaust port of cavity 27
60 Exhaust port of cavity 28
61 Exhaust port of cavity 29
62 Exhaust port of cavity 30
63 Exhaust port of cavity 31
64 Exhaust port of cavity 32
65 Dual purpose port (intake - for pumping cylinder and exhaust - for power cylinder)
6 Common combustion chamber
67 Common compression chamber
68 Longitudinal partition
69 Transverse partition
70 Crank of piston 9
71 Crank of piston 10
72 Crank o fpiston 11
73 Crank of piston 12
74 Piston rod
75 Crosshead
76 Connecting rod
77 Crank-and connecting rod assembly
78 Oil-filled crankcase
79 Spark plug
80 High pressure direct fuel injector
81 Arc groove in cylindrical surface of piston 9, facing the intake port 33
82 Bottom side wall of groove 81
83 Top side wall of groove 81
84 Top face of piston 9
85 Top edge of intake port
86 External cylindrical edge of top side wall 83 of groove 81
87 Diffuser in form of a gap between edge 86 of top side wall 83 of groove 81 and wall of cylinder 1
88 Recess in the face of power piston, open towards exhaust port
89 Top edge of exhaust port
90 Starting supercharger
91 Supercharger
92 Engine intake manifold
93 Damping chamber -continued

| | |
|---|---|
| 94 | Distribution valve |
| 95 | Cut-off valve |
| 96 | Self-acting delivery valve |
| 97 | Check valve |
| 98 | Self-acting suction valve |
| 99 | Low pressure direct fuel injector |
| 100 | Fuel pipeline |
| 101 | Low pressure external fuel injector |
| 102 | Channel, connecting cavities 17 and 19 |
| 103 | Channel, connecting cavities 17 and 25 |
| 104 | Channel, connecting cavities 17 and 26 |
| 105 | Channel, connecting cavities 17 and 28 |
| 106 | Channel, connecting cavities 18 and 19 |
| 107 | Channel, connecting cavities 19 and 20 |
| 108 | Channel, connecting cavities 17 and 20 |
| 109 | Channel, connecting cavities 19 and 26 |
| 110 | Channel, connecting cavities 19 and 27 |
| 111 | Channel, connecting cavities 19 and 28 |
| 112 | Channel, connecting cavities 21 and 23 |
| 113 | Channel, connecting cavities 25 and 28 |
| 114 | Channel, connecting cavities 25 and 26 |
| 115 | Channel, connecting cavities 26 and 27 |
| 116 | Channel, connecting cavities 27 and 28 |
| 117 | Channel, connecting cavities 25 and 27 to cavities 17 and 26 |
| 118 | Channel, connecting cavity 17 to cavity 19 or to the engine intake manifold |
| 119 | Channel, connecting cavity 19 to cavity 21 or to the engine intake manifold |
| 120 | Channel, connecting cavities 19, 21, 27, 28, 29 and 30 to the engine intake manifold |

DETAILED DESCRIPTION OF THE INVENTION

Present invention is applicable to the following three types of TSICE:

1) spark ignited (e.g. gasoline, propane) engine with an external mixing of air and fuel in the intake manifold and use of air-fuel mixture for scavenging of power cylinders;
2) spark ignited (e.g. gasoline) engine with scavenging of power cylinders with pure air and direct fuel injection into the power cylinders at the beginning of compression stroke after their ports are already closed;
3) self-ignited (diesel) engine with scavenging of power cylinders with pure air and direct fuel injection into the power cylinders at the end of compression stroke.

All three types of engines have an oil-filled crankcase. TSICE charged with air-fuel-oil mixture through a dry crankcase are not considered, since they are pollutive and have other known disadvantages.

If exhaust ports of the power cylinders close before their intake ports, charging of power cylinders can continue after the exhaust ports are closed, making coefficient of admission possibly more than 1.0.

In TSICE of second and third types cylinders are scavenged/charged with pure air, having fuel injected directly into the cavity of power cylinder. In these engines low pressure fuel injector 101 in the engine intake manifold is not present. Instead, in the second type of spark-ignited engine low pressure direct fuel injector 99 installed in the power cylinder is used together with a spark plug 79. In self-ignited TSICE of the third type spark plug 79 is replaced with a high pressure direct fuel injector 80. The direct injection of fuel into the power cylinders after scavenging is complete and ports of the power cylinders are closed, eliminates fuel loss and mixing of a fresh charge with burned gases.

Drawings and descriptions are made as for the first type of TSICE.

Figure 6:
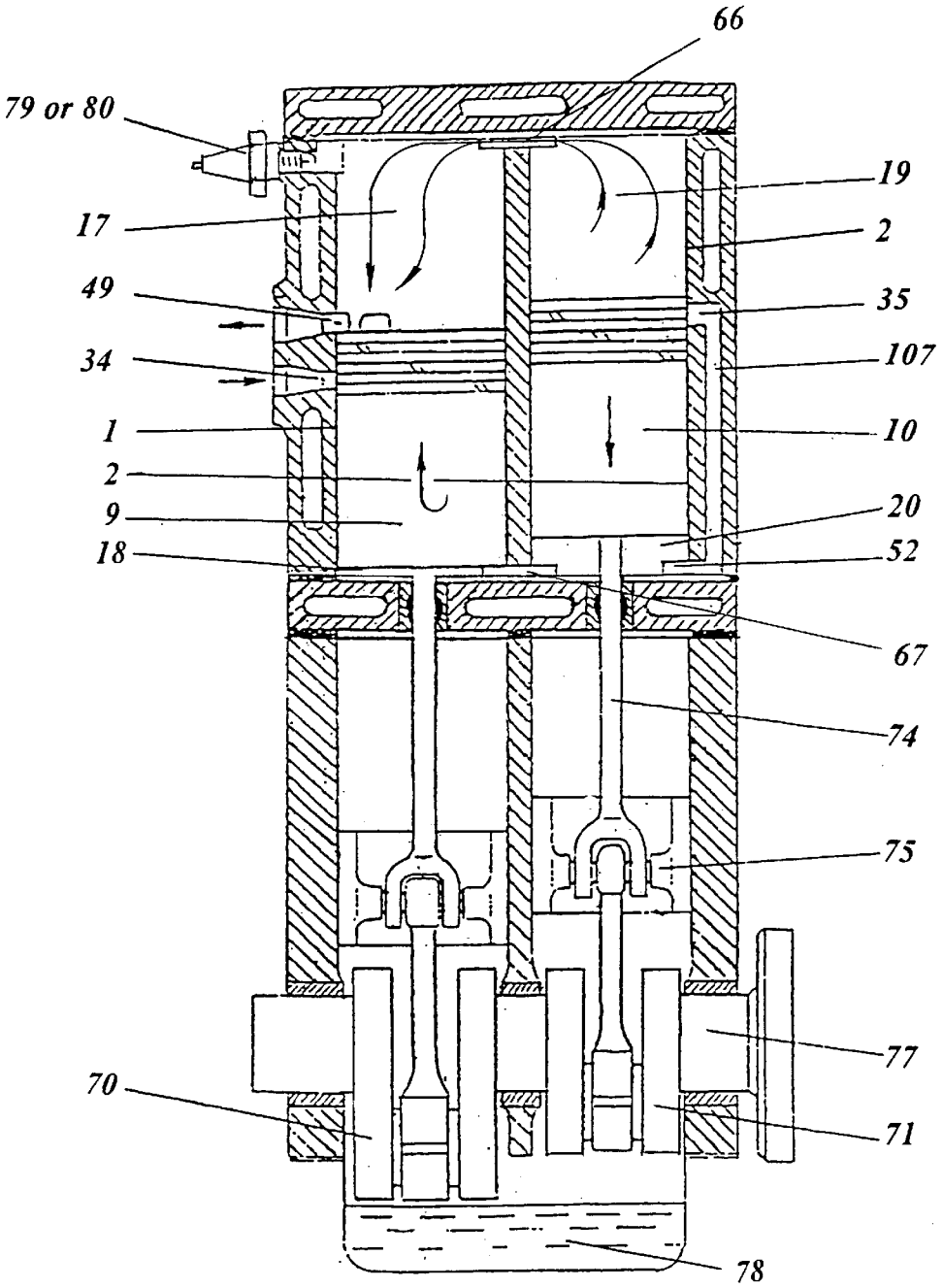
FIG. 6 shows TSICE comprising two double-sided cylinders with two pumping and two power cavities and piston cranks having angular deviation $\beta°$ against each other.
Figure 7A:
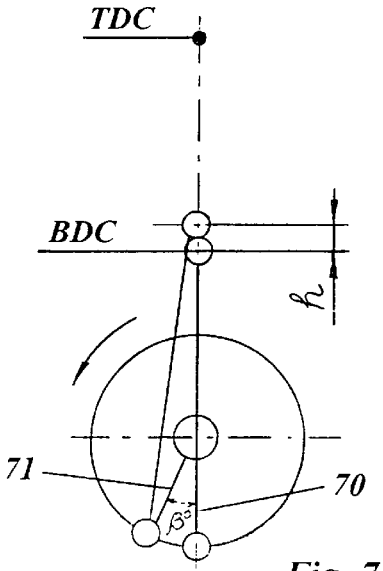
FIGS. 7A . . . 7D show the crank angle diagrams of TSICE with the crank of the first cylinder advanced by $\alpha°=\beta°$ in relation to the crank of the second cylinder.
Figure 7B:
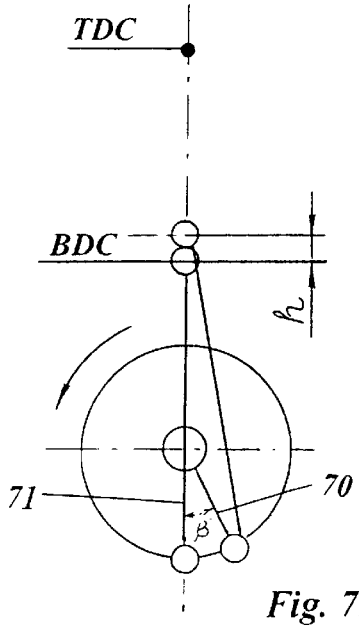
Figure 7C:
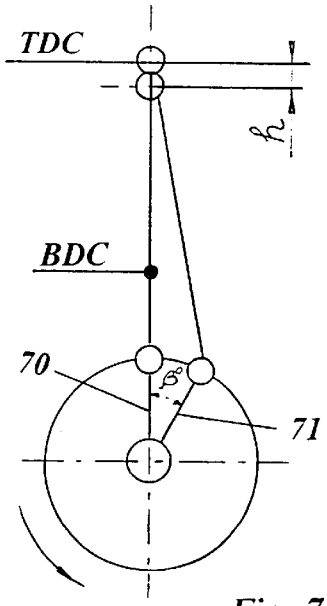
Figure 7D:
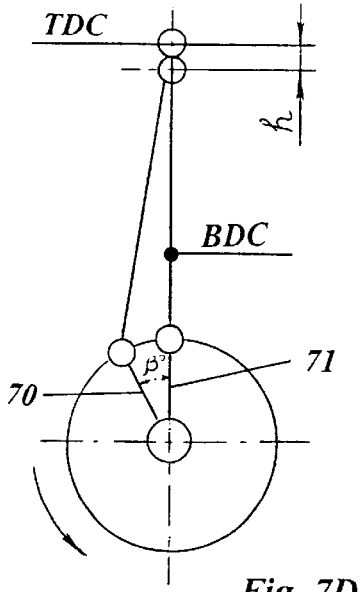

One of the embodiments of the present invention, shown on FIG. 6, has two double-sided cylinders 1 and 2, whose upper cavities 17 and 19 are power cavities, and lower cavities 18 and 20 are pumping cavities. Cavities 17 and 19 have common combustion chamber 66. Cavities 18 and 20 have common compression chamber 67. Power cavity 17 has the exhaust port 49, and power cavity 19 has the intake port 35. Pumping cavity 18 has the intake port 34, and pumping cavity 20 has the exhaust port 52, which is connected to the intake port 35 by the channel 107. Crank 70 of the piston 9 has an advanced by β° crank angle against crank 71 of the piston 10, as shown in FIGS. 7A . . . 7D, enabling advanced opening and closing of the exhaust port 49 in relation to the intake port 35. Angle β° is an angle of rotation of crank 70, corresponding to the piston 9 move from BDC to the piston, where piston 9 closes the exhaust port 49.

The method of operation of the TSICE on FIG. 6 is as follows.

At the end of the power stroke, when piston 9 of the power cylinder is at BDC, as shown in FIG. 6, crank 71 still has β° to turn, before piston 10 will each BDC.

With piston 9 at BDC, the exhaust port 49 is completely open, allowing the escape of burned gases from cavities 17 and 19. Piston 10 still has not reached BDC and the intake port 35 is still closed. When piston 9 moves up from BDC, and piston 10 still continues going down to its BDC, the exhaust port 49 starts closing simultaneously with opening of the intake port 35. At this time a direct-flow scavenging of power cavities takes place. A fresh portion of air-fuel mixture entering through the intake port 35, fills consequently cavities 19 and 17, pushing out burned gases through the exhaust port 49. Compressed air-fuel mixture is delivered to the intake port 35 by the channel 107 from the pumping cavities 18 and 20. When the piston 10 reaches BDC and opens completely the intake port 35, piston 9 completely closes the exhaust port 49, which represents the end of scavenging. The charging of the cavities 19 and 17 with fresh air-fuel mixture continues through the still open intake port 35, until it is completely closed by the piston 10, moving up from BDC. After the closing of the port 35, the air-fuel mixture is compressed in power cavities 17 and 19. Pistons 9 and 10, move up, piston 9 reached TDC first, and when it starts going down and piston 10 reaches TDC, ignition of compressed air-fuel mixture happens, initiating a power stroke. While moving up, pistons 9 and 10 create a vacuum in the pumping cavities 18 and 20. When the piston 9 reaches TDC, it opens the intake port 34, and the created vacuum induces suction of fresh-air fueled mixture into the pumping cavities 18 and 20. During the power stroke, moving down, pistons 9 and 10 compress it, and at the end of power stroke, the process of scavenging/charging of the power cavities starts, as described above.

Figure 8:
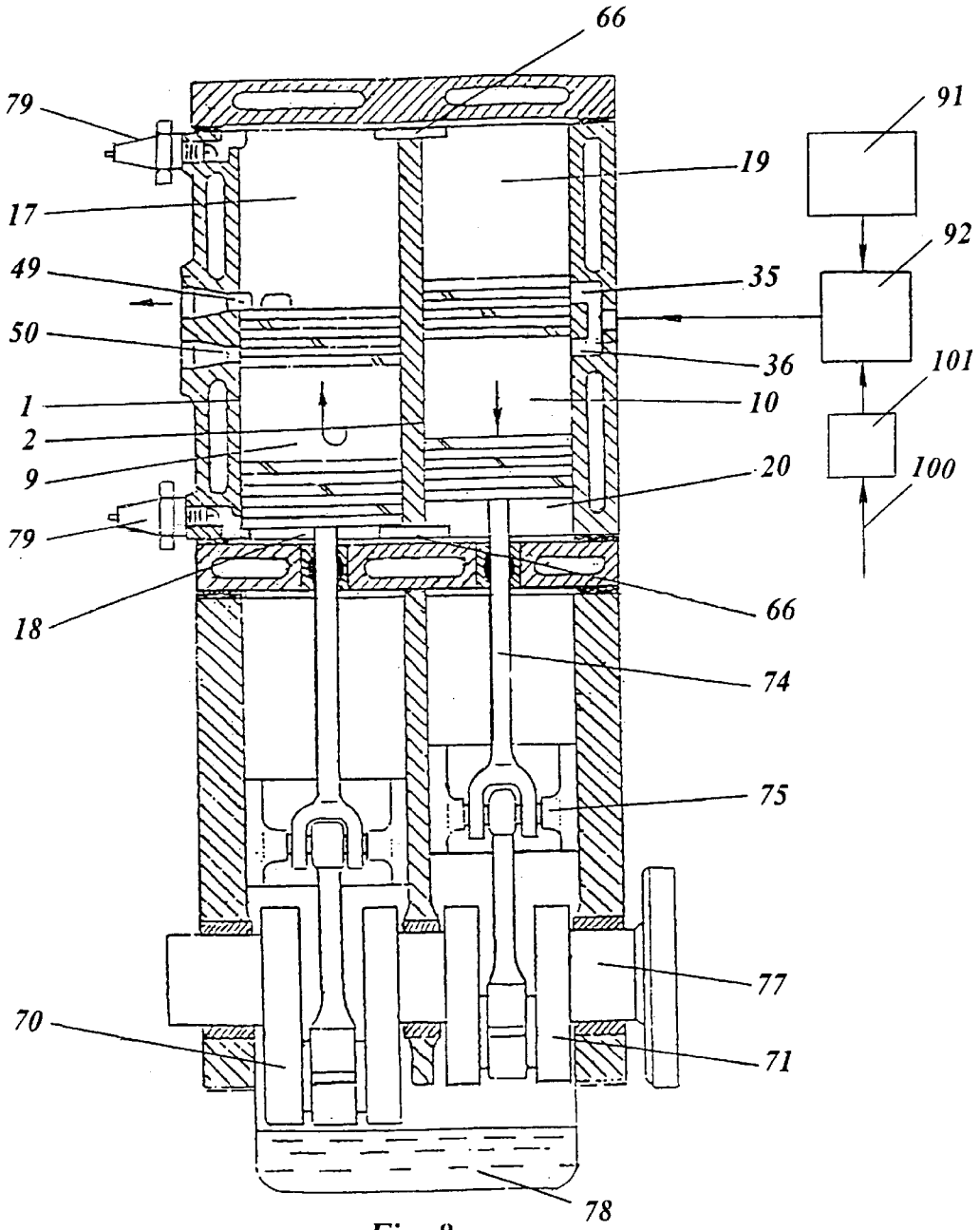
FIG. 8 shows TSICE comprising two double-sided cylinders, with four power cavities, connected to external supercharger, and piston cranks having angular deviation $\beta°$ against each other.

Another embodiment of the present invention, shown in FIG 8, has two double-sided cylinders 1 and 2, but unlike the engine on FIG. 6, it has all cavities being power cavities, including upper cavities 17 and 19 and lower cavities 18 and 20. Each pair of cavities has its common combustion chamber 66 and the spark plug 79. Instead of pumping cavities used in engine on FIG. 6, an external source of scavenging is used, like the supercharger 91, which can be driven by an electric motor or by the engine itself, or by the energy of exhaust gases (turbo-supercharger). The cavities 17 and 18 have exhaust ports 49 and 50, and the cavities 19 and 20 have intake ports 35 and 36. Air-fuel mixture from the supercharger 91 is delivered with constant pressure to the intake ports 35 and 36. The crank 70 of the piston 9 has a crank angle advanced by β° against the crank 71 of the piston 10, as shown on FIG. 7, enabling advanced opening and closing of the exhaust port 49 in relation to the intake port 35 and the exhaust port 50 in relation to the intake port 36.

The method of operation of the TSICE on FIG. 8 is as follows.

At the end of the power stroke, when piston 9 of the power cylinder is at BDC, as shown on FIG. 8, the crank 71 still has β° to turn, before the piston 10 will reach BDC.

With piston 9 at BDC exhaust port 49 is completely open allowing the escape of burned gases from cavities 17 and 19. Piston 10 still has not reached BDC and the intake port 35 is still closed. When piston 9 moves up from BDC, and piston 10 still continues going down to BDC, the exhaust port 49 starts closing simultaneously with opening of the intake port 35, which initiates a direct-flow scavenging of cavities 19 and 17 with pressurized air-fuel mixture from the supercharger. The scavenging continues until the exhaust port 49 is closed. At that moment, the piston 10 reaches BDC, and the intake port 35 remains open until completely closed by piston 10, moving up from BDC. This allows the supercharger to create excessive pressure of air-fuel mixture inside the cavities 19 and 17. During the compression stroke the pistons 9 and 10 reach TDC one before another. When piston 10 reaches TDC, the compressed air-fuel mixture is ignited by a spark plug and a power stroke starts. The pistons 9 and 10 go down and after the piston 9 reaches BDC a new cycle begins. Operation of power cavities 18 and 20 goes exactly the same way, as of cavities 17 and 19, described above, but with the opposite timing. That doubles the amount of power, generated by the TSICE, compared with the TSICE on FIG. 6. Additional increase of power per liter of displacement is achieved by the use of a supercharger, which makes the coefficient of admission of the power cylinders more than 1.0.

Figure 5A:
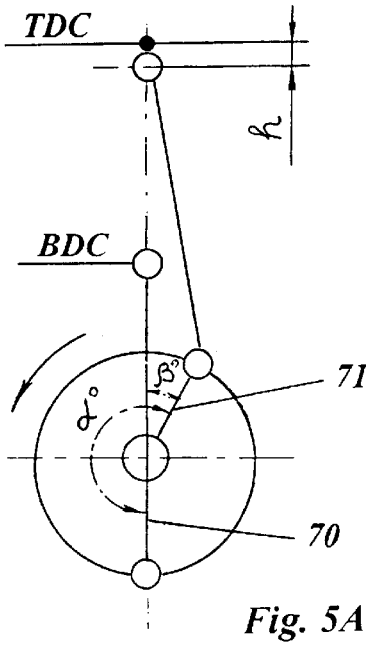
FIGS. 5A . . . 5D show the crank angle diagrams of TSICE with the crank of the first cylinder advanced by $\alpha°=180°+\beta°$ in relation to the crank of the second cylinder.
Figure 5B:
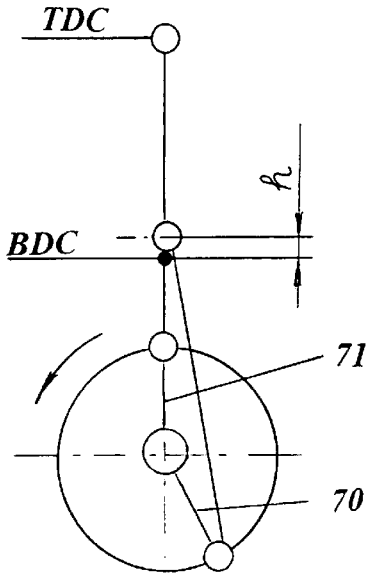
FIGS. 5 . . . 10 illustrate preferred embodiments of the present invention and their crank diagrams.
Figure 5C:
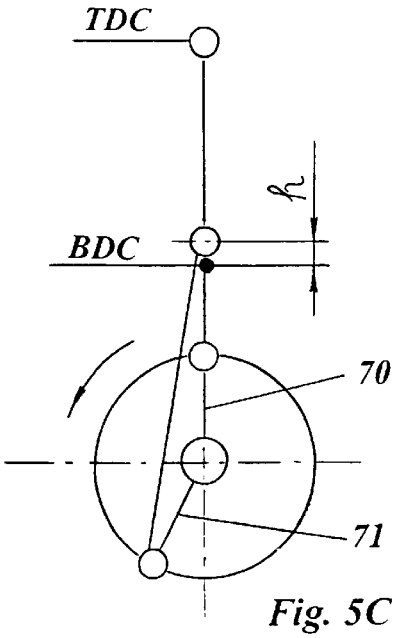
Figure 5D:
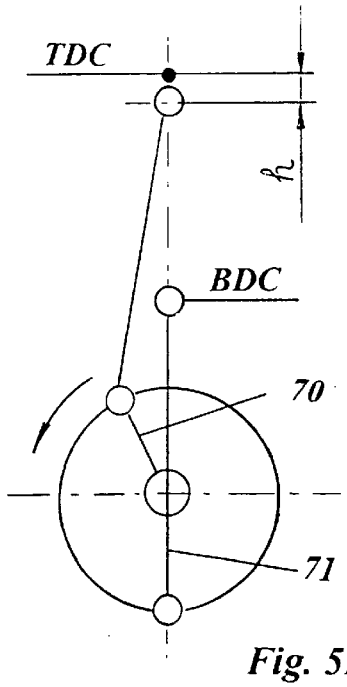
Figure 9A:
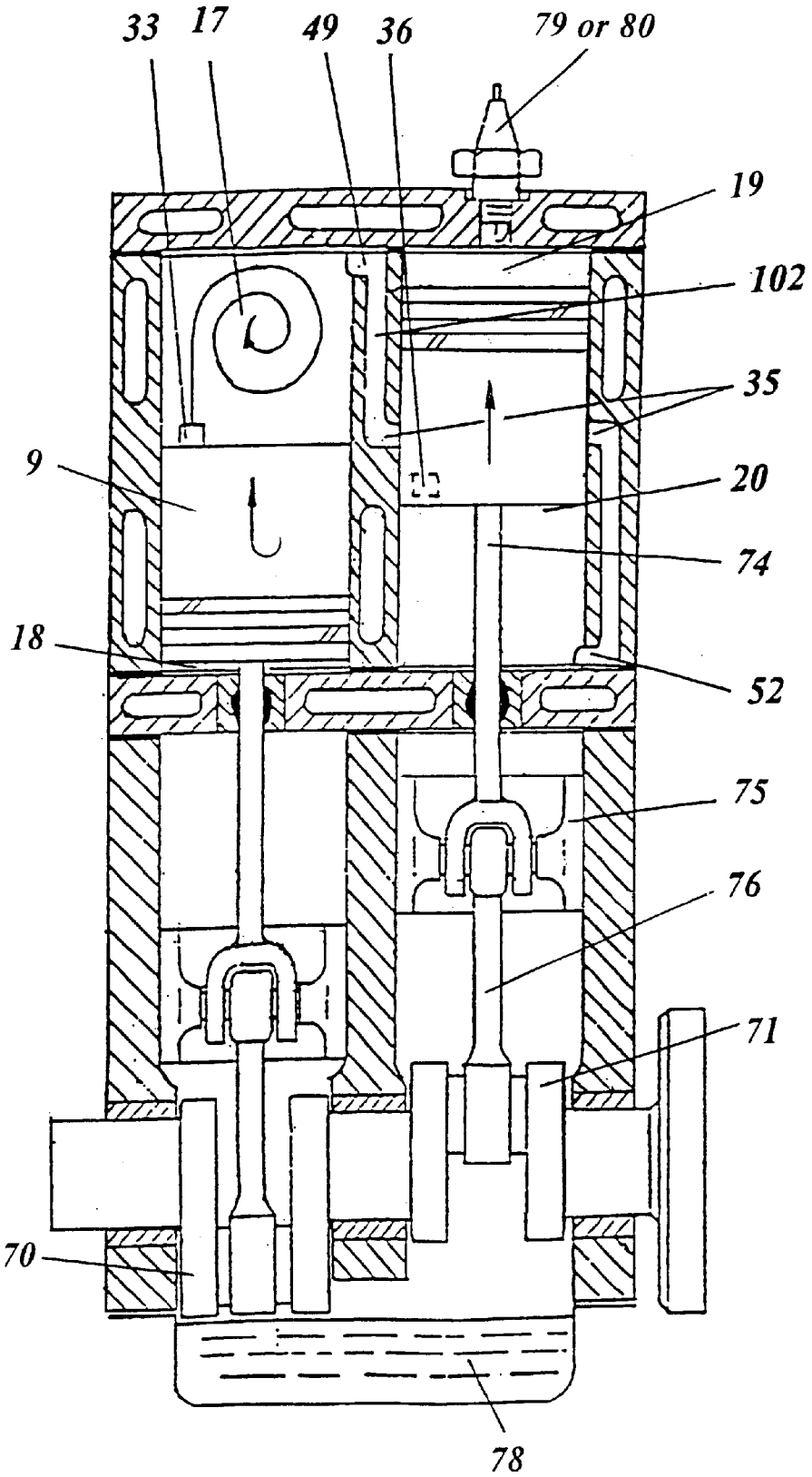
FIGS. 9A . . . 9D show TSICE comprising two double-sided cylinders with two pumping and two power cavities and piston cranks having angular deviation $180°+\beta°$ against each other.

TSICE shown on FIGS. 9A . . . 9D is the third embodiment of the present invention with double-sided cylinders 1 and 2, where pistons 9 and 10, reciprocally movable therein, are connected to cranks 70 and 71. The crank 70 has a crank angle, advanced against crank 71 by $\alpha°=180°+\beta°$, as shown on FIGS. 5A . . . 5D, where β° is an angle of rotation of crank 70, corresponding to the piston 9 move from TDC down to the position when piston 9 closes the exhaust port 50. The cavities 18 and 19 are power cavities, connected to each other by channel 106, shown on FIGS. 9C, 9D. The channel 106 represents the common combustion chamber for cavities 18 and 19, which have the common spark plug 79, common intake ports 35, located in cavity 19, and common exhaust port 50, located in cavity 18. Cavities 17 and 20 are pumping cavities. They have individual intake ports 33 and 36 and exhaust ports 49 and 52, connected to the intake ports 35 by channels 102 and 107.

The method of operation of the TSICE on FIGS. 9A . . . 9D is as follows.

Figure 9B:
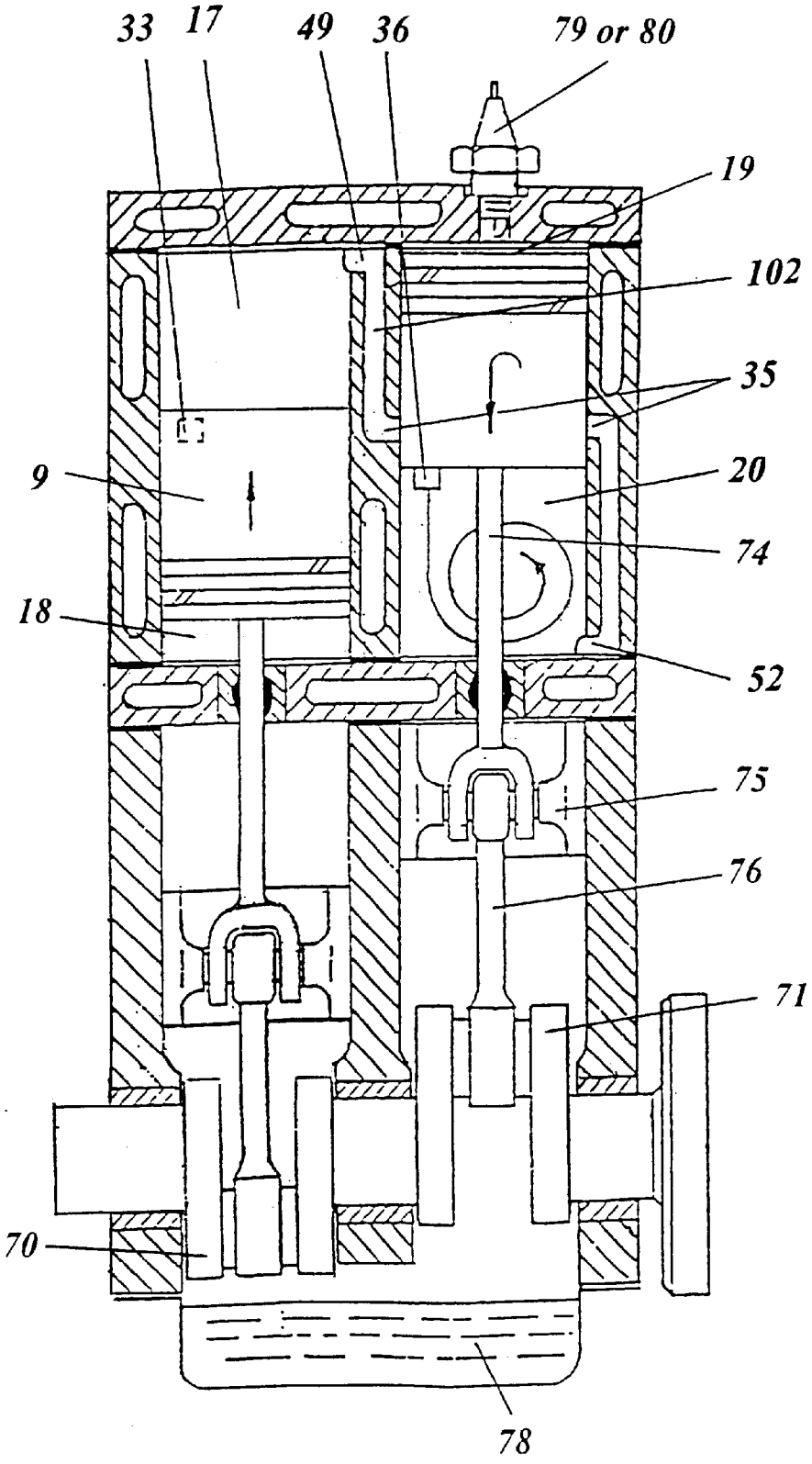
FIG. 9E shows four-cylinder TSICE, which is a combination of two engines, presented on FIGS. 9A . . . 9D.
Figure 9C:
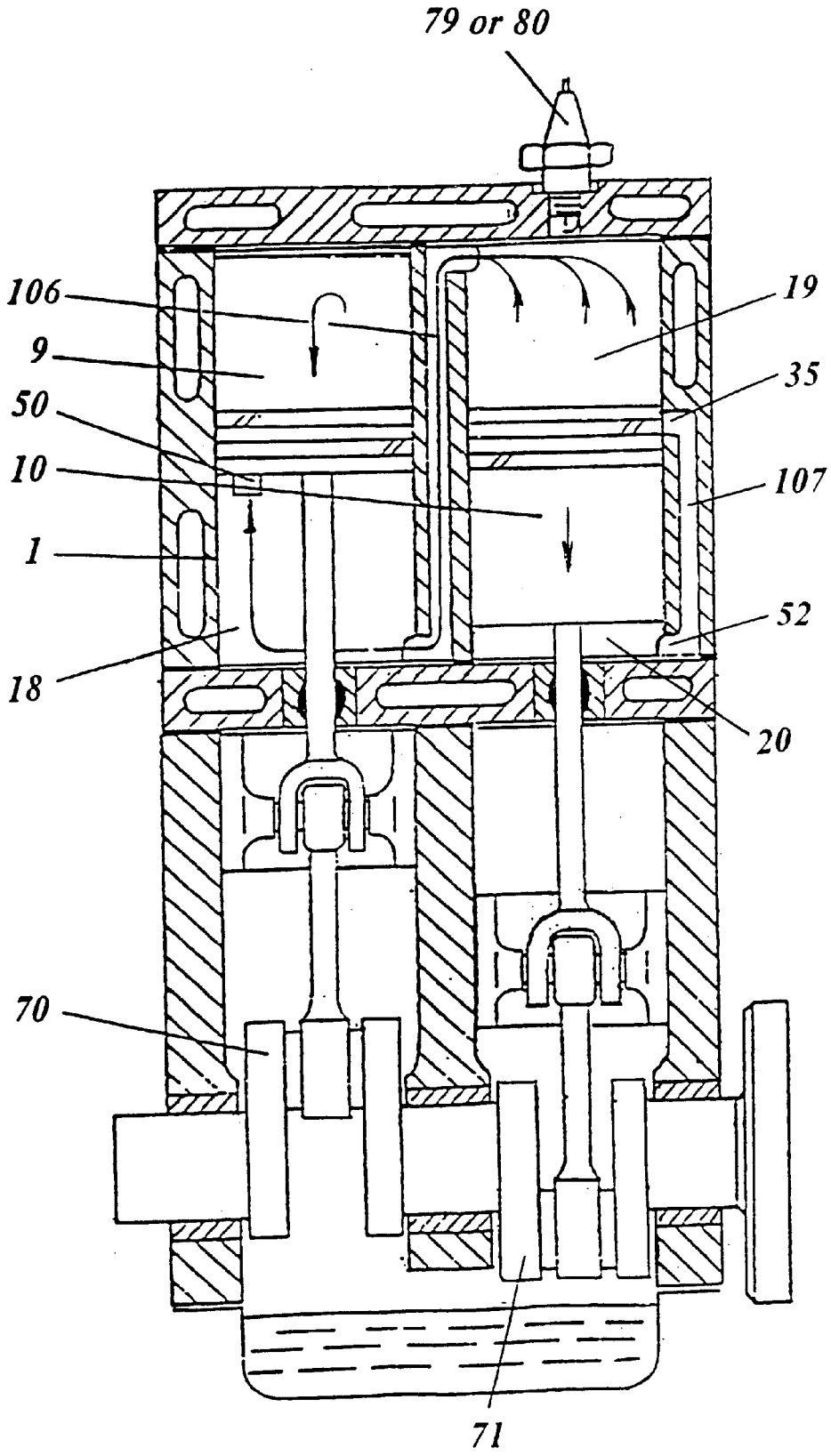
Figure 9D:
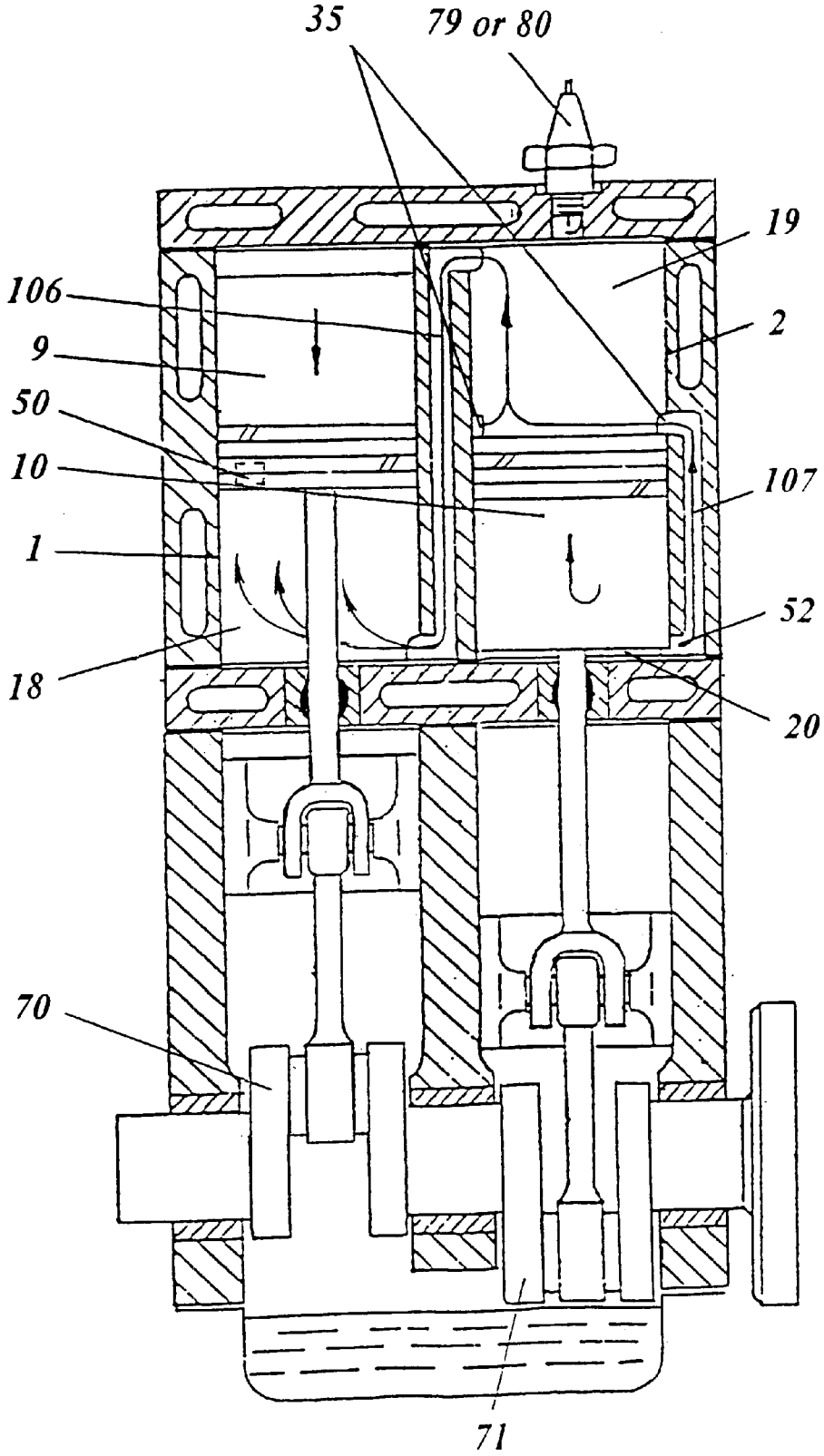

At the end of a compression stroke, as shown on FIGS. 9A and 9B, air-fuel mixture is compressed in the power cavities 18 and 19 and a vacuum is created in the pumping cavities 17 and 20. When the piston 9 of the power cylinder is at BDC (FIG. 9A), the intake port 33 opens and vacuum inside the pumping cavity 17 draws in a fresh portion of air-fuel mixture. The crank 71 still has β° to turn, before piston 10 will reach TDC. When that happens (FIG. 9B), the intake port 36 opens and vacuum inside the pumping cavity 20 draws in a fresh portion of air-fuel mixture. At the same time, air-fuel mixture, compressed in power cavities 18 and 19 is ignited with the spark plug 79, and a power stroke begins with simultaneous compression of a new portion of air-fuel mixture in the pumping cavities 17 and 20. When piston 9, on its way up, reaches TDC (FIG. 9C) the exhaust port 50 opens, allowing the release of the burned gases from the power cavities. Since then, both pistons move down: the piston 9, closing the exhaust port 50, and the piston 10, opening the intake ports 35 of power cylinders. Until the exhaust port 50 closes, the direct-flow scavenging/charging of the power cavities 19 and 18 goes on. Compressed in the pumping cavities 17 and 20, an air-fuel mixture is released through the channels 102 and 107 into the cavity 19 and from there through the channel 106 into the cavity 18, pushing the rest of the burned gases out of the exhaust port 50. The process of scavenging ends when the piston 10 reaches BDC and the piston 9 closes the exhaust port 50 (FIG. 9D). The intake ports 35 remain open and process of charging of the power cylinders continues until piston 10, moving up from BDC, closes ports 35, and another compression stroke starts.

An advantage of this version of TSICE is that the phase opposition of the cranks 70 and 71 balances the forces applied to the crankshaft bearings and inertial masses of the engine.

Figure 9E:
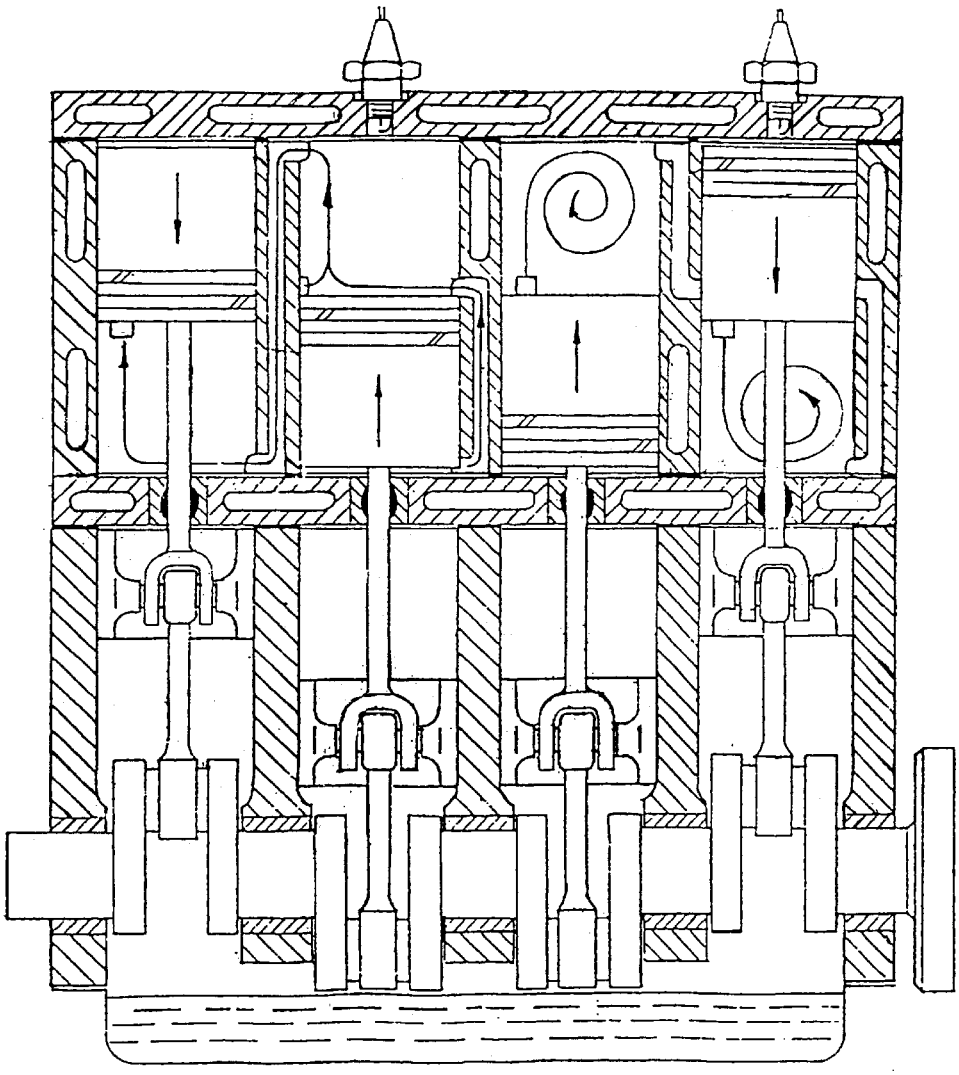

In practical applications for smoother performance this type of engine will include four double-sided cylinders, combined in pairs, as shown on FIG. 9E.

Figure 10A:
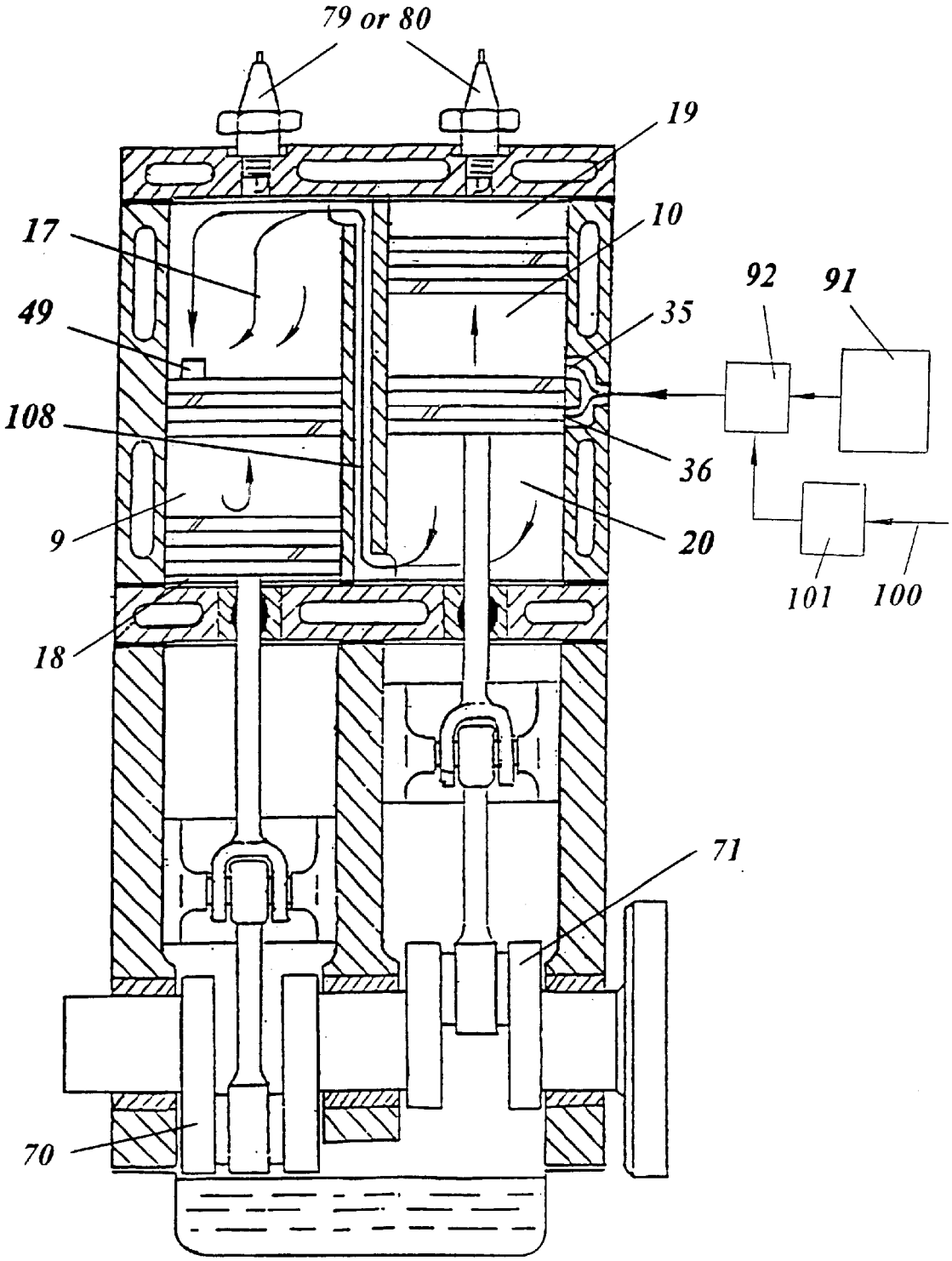
FIGS. 10A . . . 10D show TSICE comprising two double-sided cylinders, with four power cavities, connected to external supercharger, and piston cranks having angular deviation 180°+β° against each other.

TSICE according to the present invention, shown on FIGS. 10A . . . 10D, unlike the previous embodiment, has all four cavities of two double-sided cylinders being power cavities. The power cavities 18 and 19 are connected by the channel 106, as shown on FIGS. 10C, 10D. The power cavities 17 and 20 are connected by the channel 108, as shown on FIGS. 10A, 10B. Each pair of cavities has its own spark plug 79. The cavities 18 and 19 have the common intake port 35 and exhaust port 50. The cavities 17 and 20 have the common intake port 36 and the exhaust port 49. The crank 70 has a crank angle, advanced against the crank 71 by $\alpha°=180°+\beta°$, as shown on FIGS. 5A . . . 5D, where β° is an angle of rotation of the crank 70, corresponding to the piston 9 move from BDC up to the position when the piston 9 closes the exhaust port 49. Since cylinders of this TSICE do not have pumping cavities, the external supercharger 91, connected by the intake manifold 92 to the intake ports, is used for scavenging/charging of the power cavities.

The method of operation of the TSICE on FIGS. 10A . . . 10D is as follows.

Figure 10B:
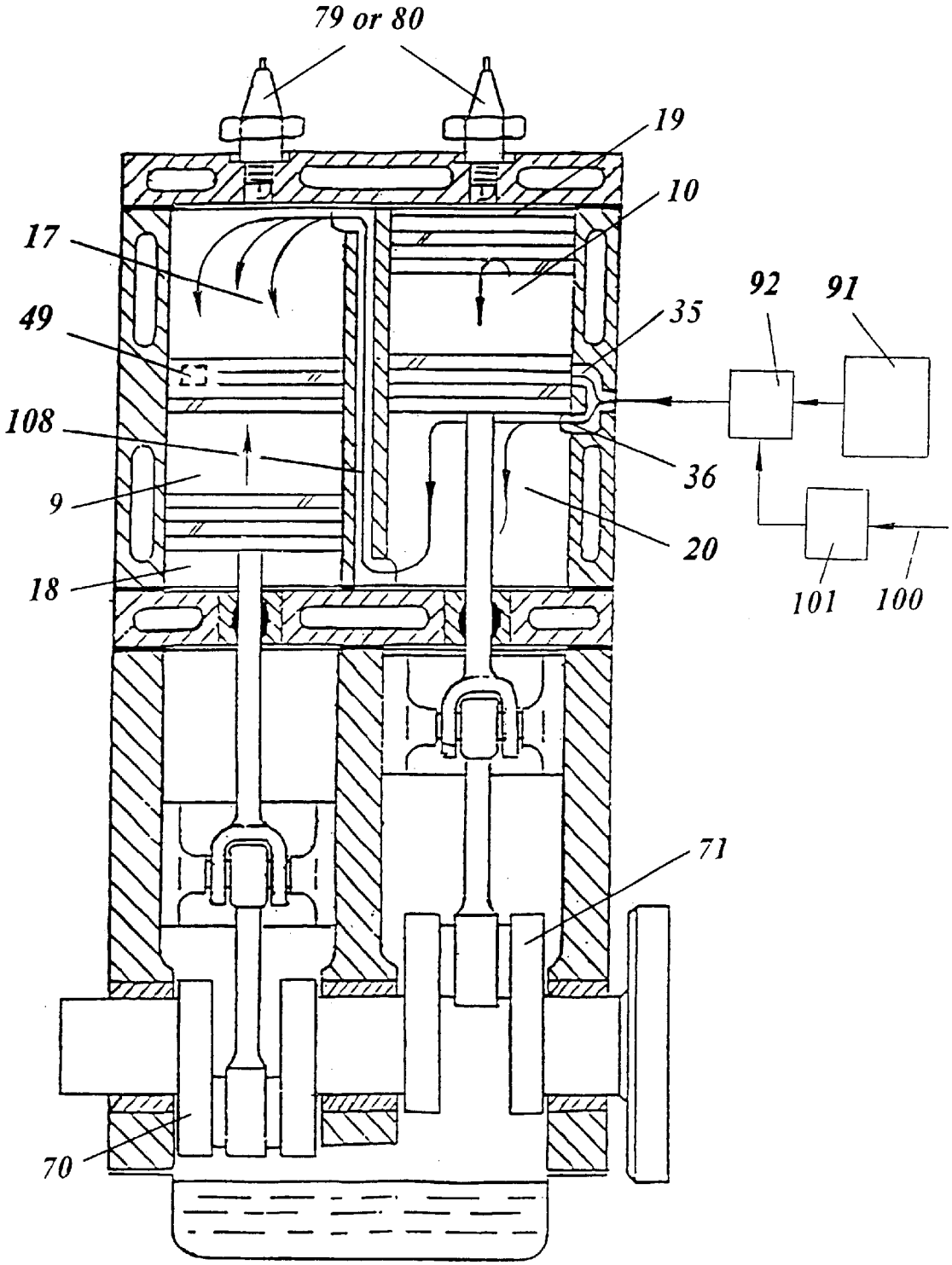
Figure 10C:
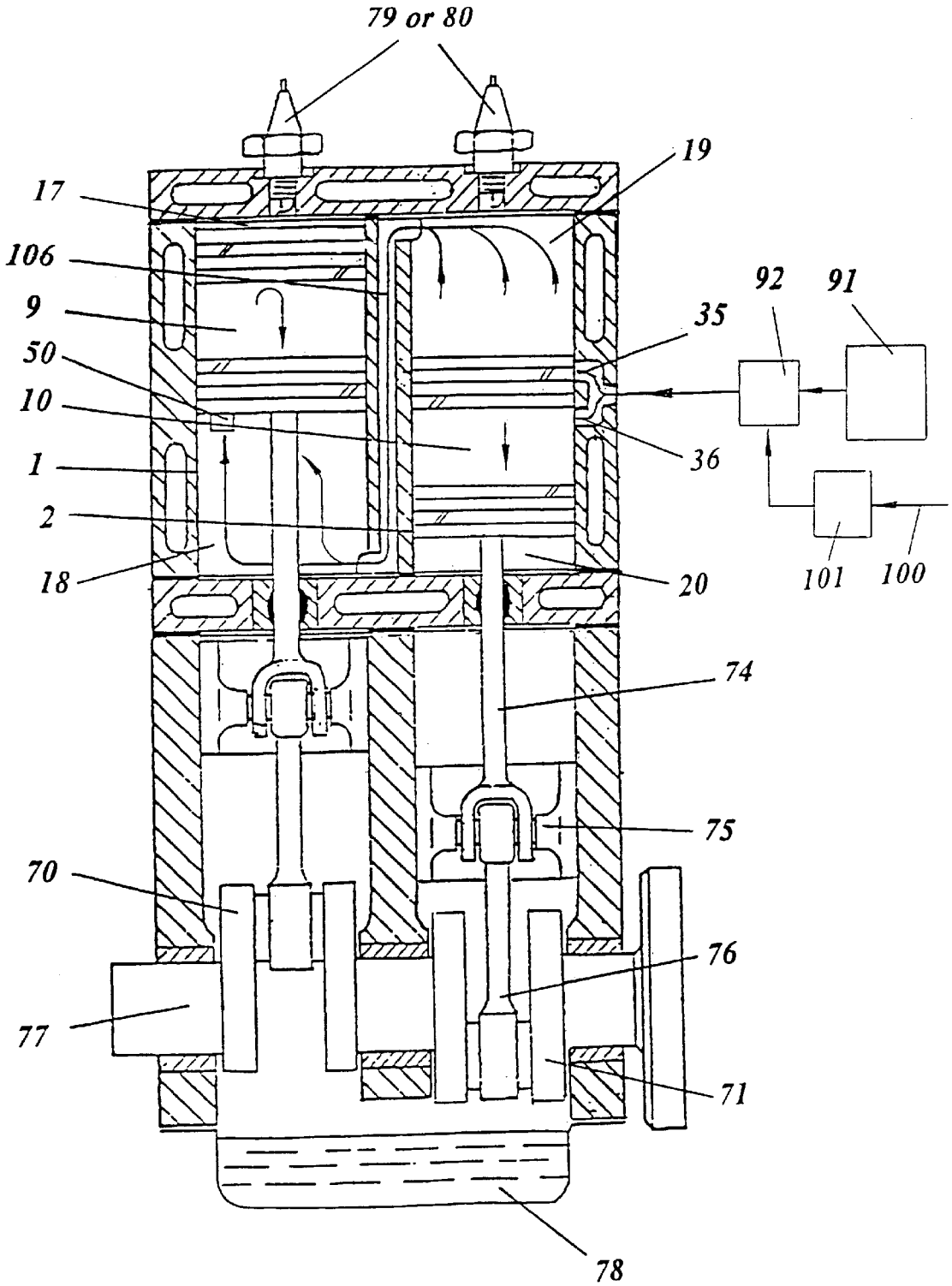
Figure 10D:
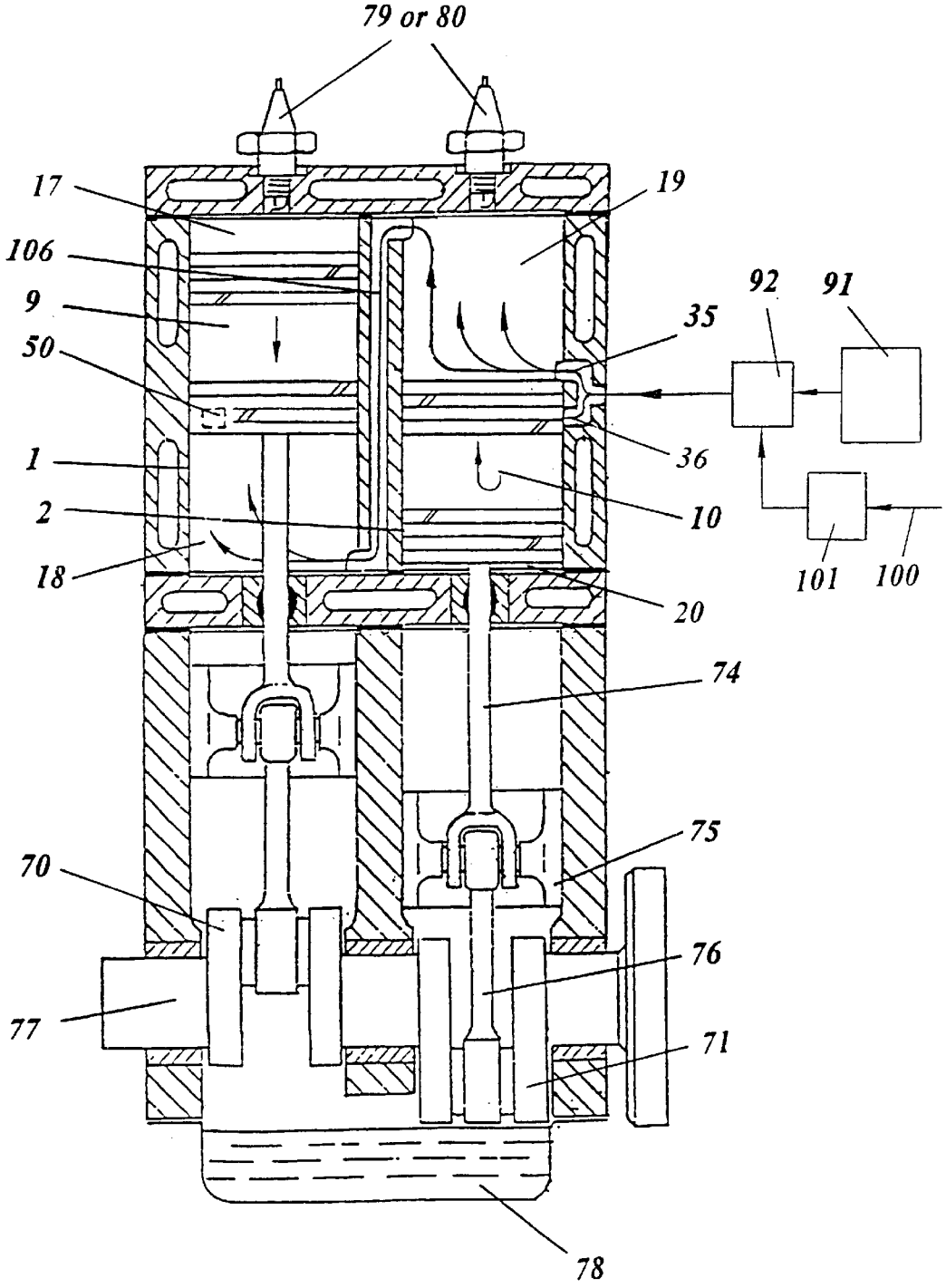
Figure 11:
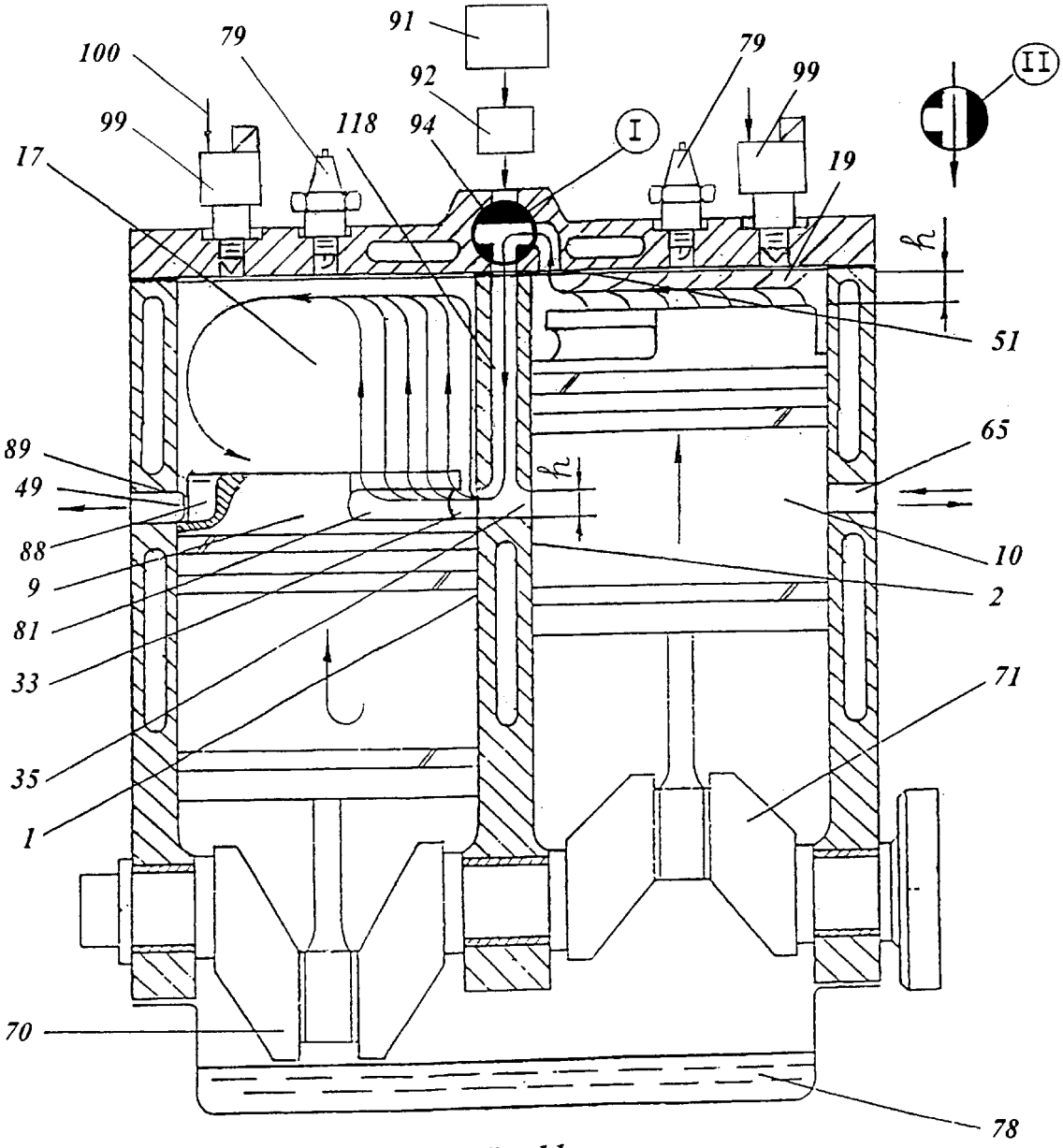
FIG. 11 shows TSICE comprising one power cylinder and one dual action cylinder, connected to a supercharger through a distribution valve.
Figure 12:
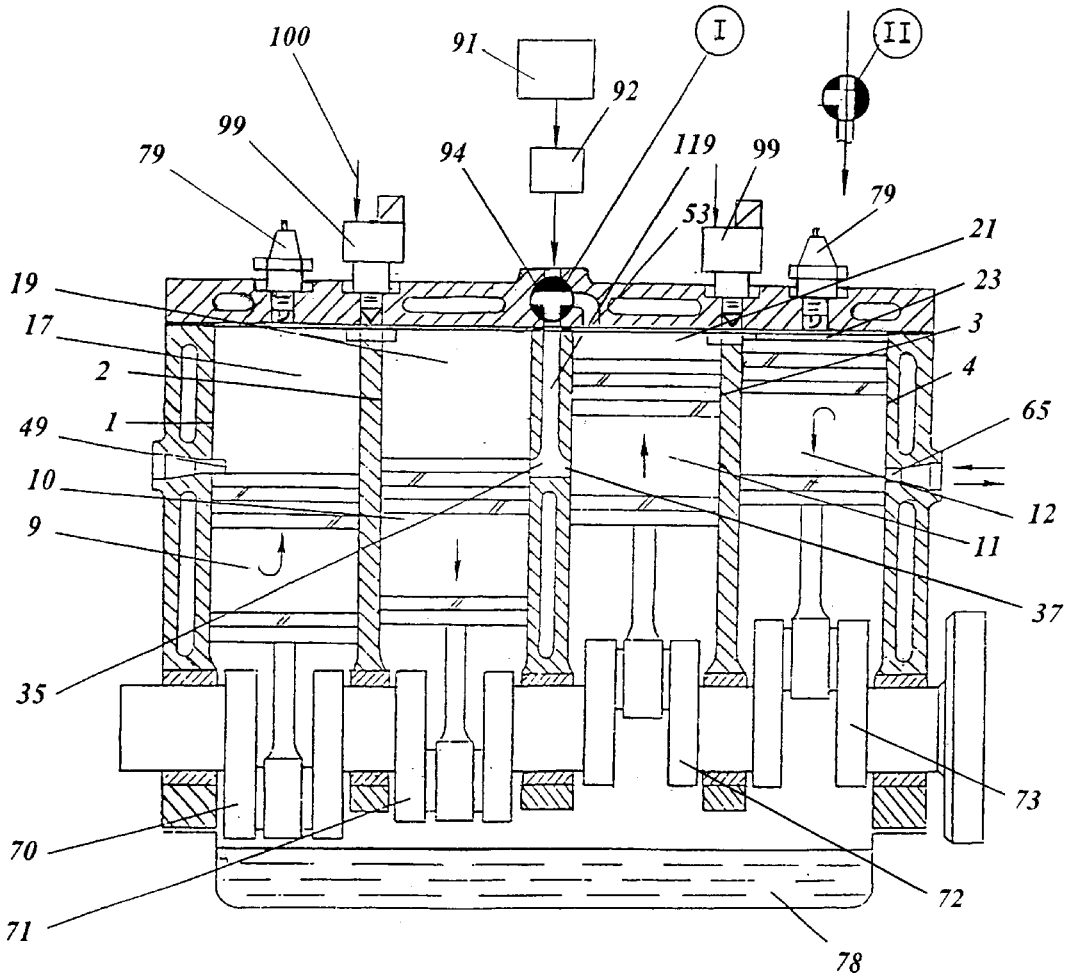
FIG. 12 shows TSICE comprising two power cylinders and two dual action cylinders, connected to a supercharger through a distribution valve.
Figure 13:
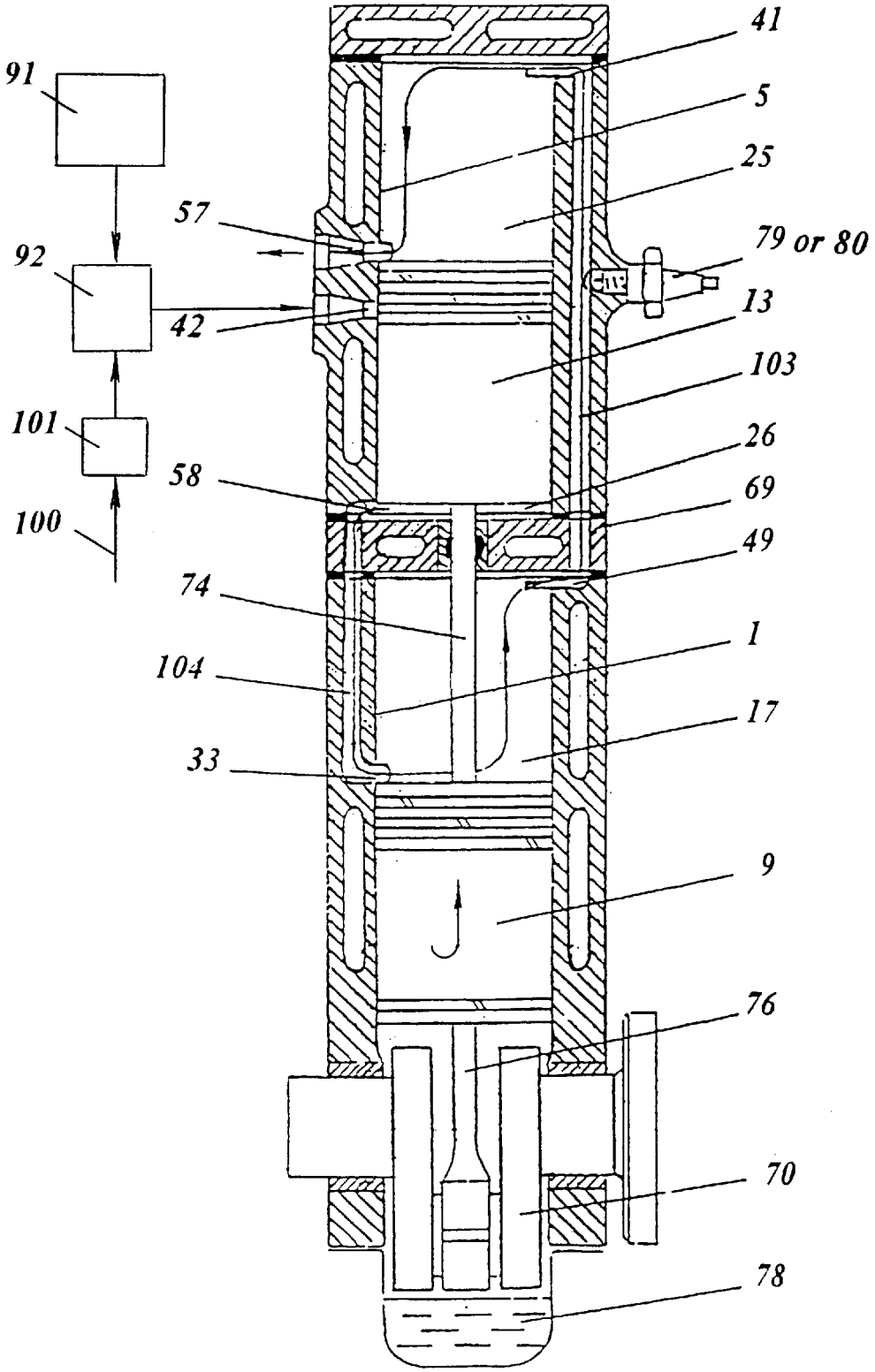
FIG. 13 shows single-row double-bank TSICE comprising power cylinder in the first bank and double-sided cylinder in the second bank with pumping cavity, connected to a supercharger.
Figure 14:
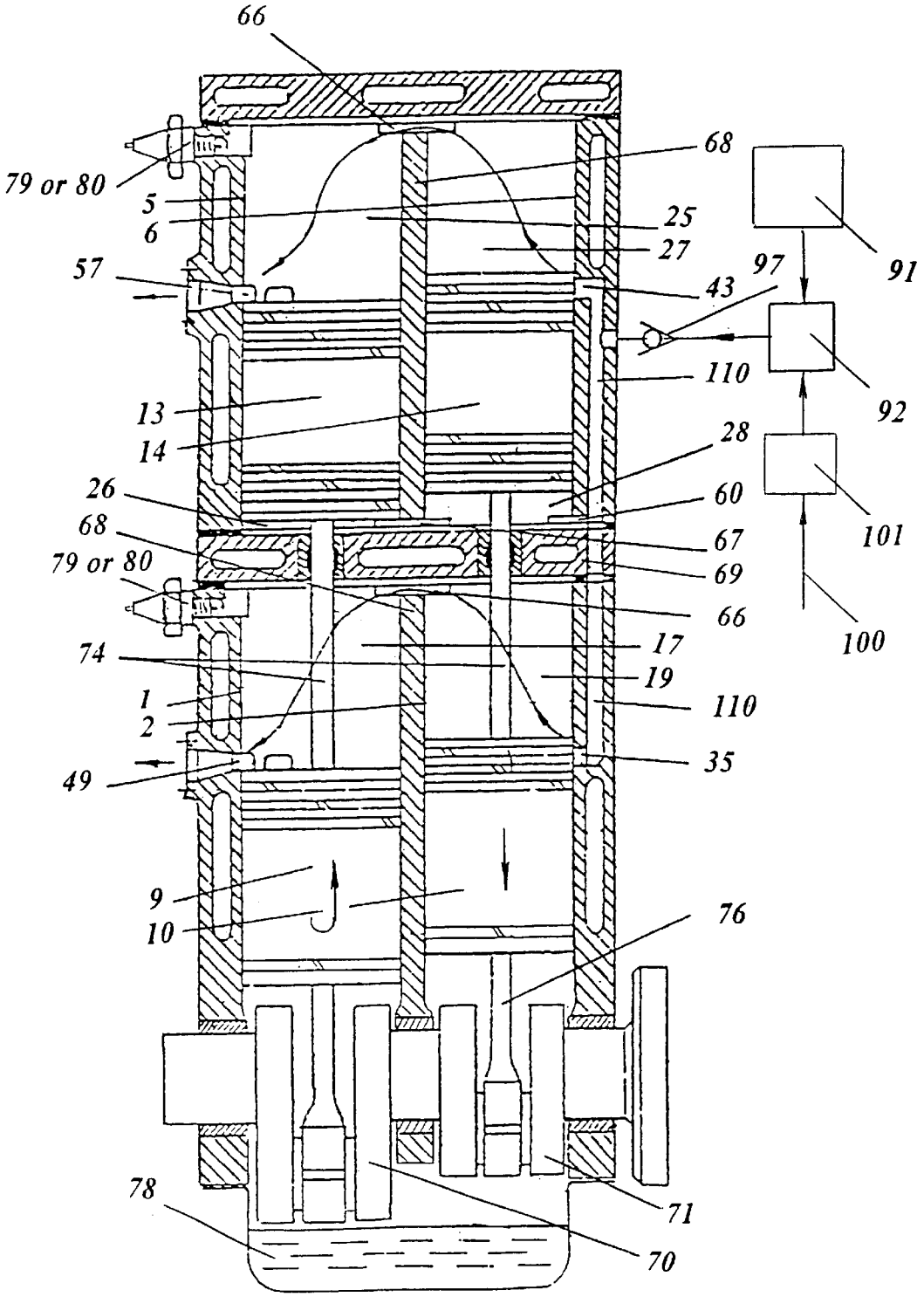
FIG. 14 shows double-row double-bank TSICE comprising two power cylinders in the first bank and two double-sided cylinders in the second bank with pumping cavities, connected to a supercharger, and piston cranks having angular deviation β° against each other.
Figure 15A:
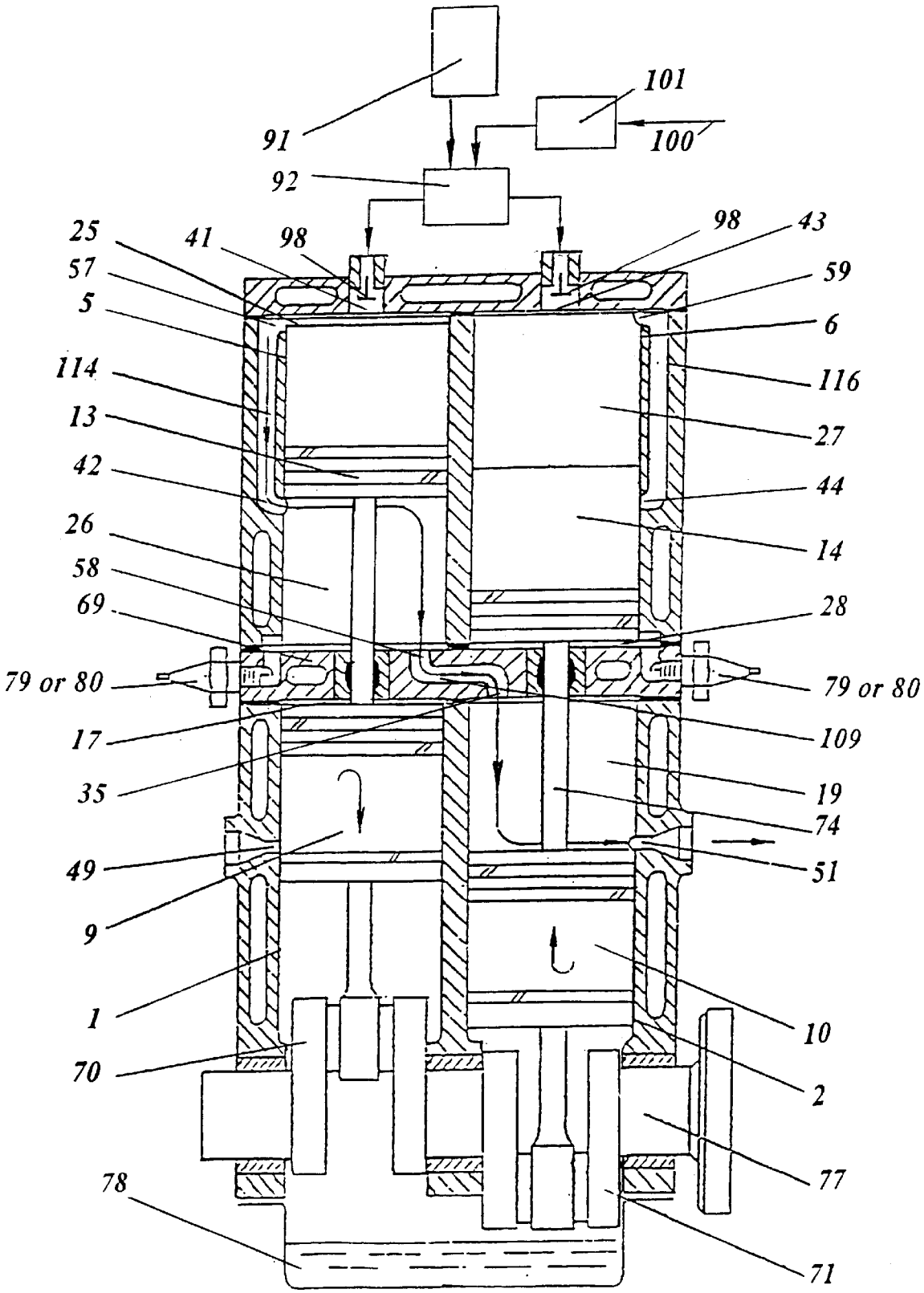
FIGS. 15A, 15B show double-row double-bank TSICE comprising two power cylinders in the first bank and two double-sided cylinders in the second bank with pumping cavities, connected to a supercharger, and piston cranks having angular deviation 180°+β° against each other.
Figure 15B:
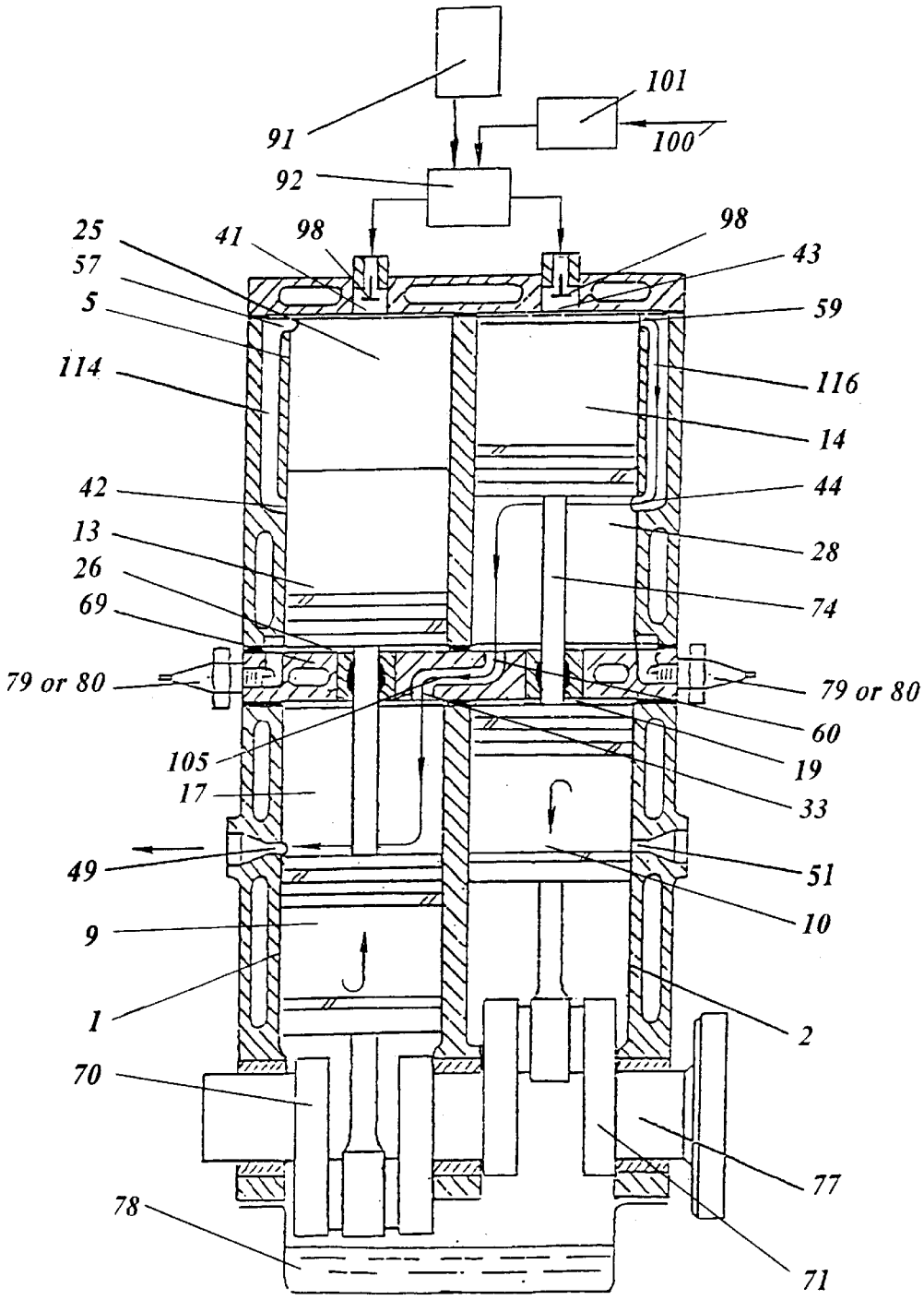
Figure 16A:
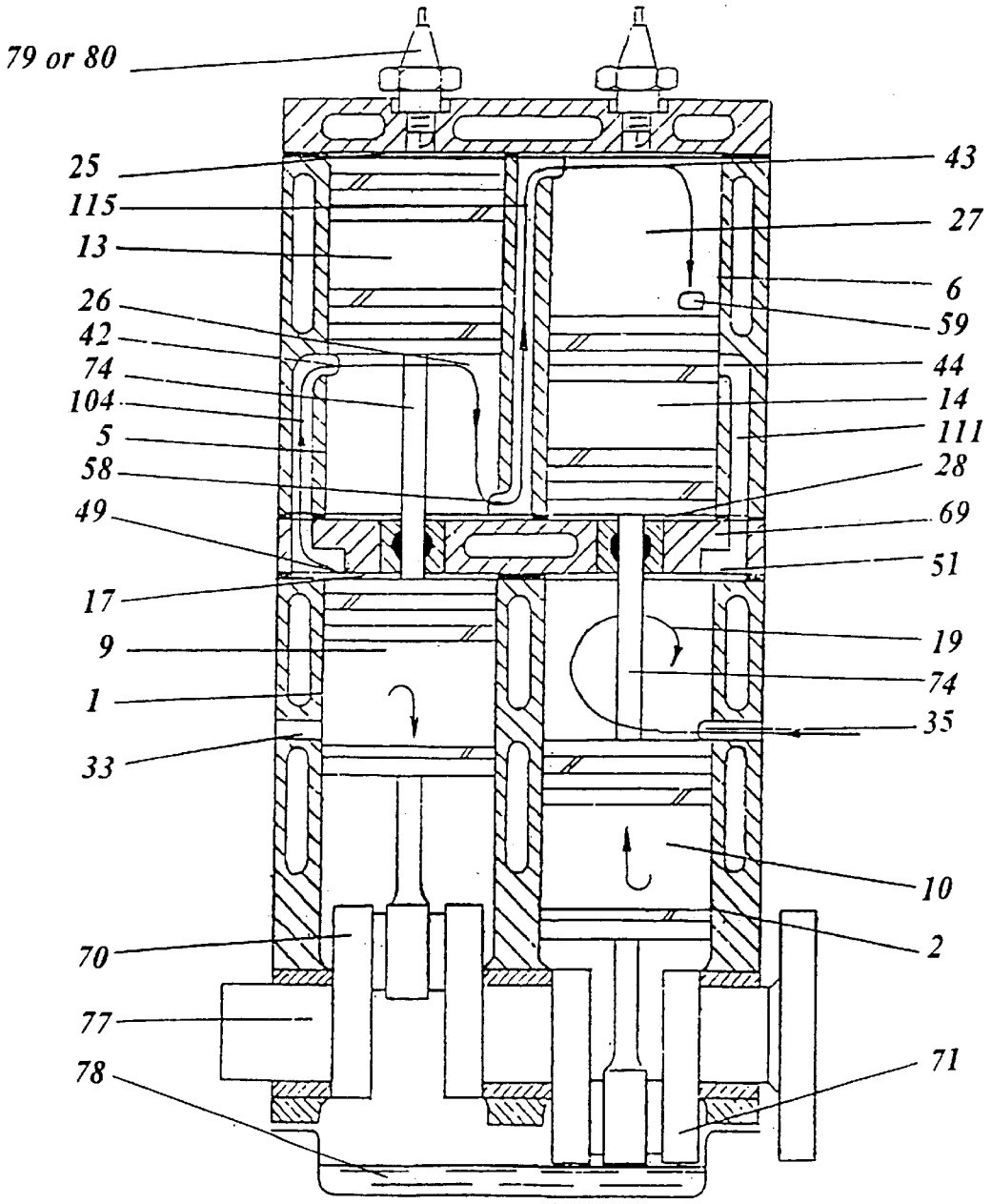
FIGS. 16A, 16B show double-row double-bank TSICE comprising two pumping cylinders in the first bank, connected to a supercharger, and two double-sided cylinders in the second bank with piston cranks having angular deviation 180°+β° against each other.
Figure 16B:
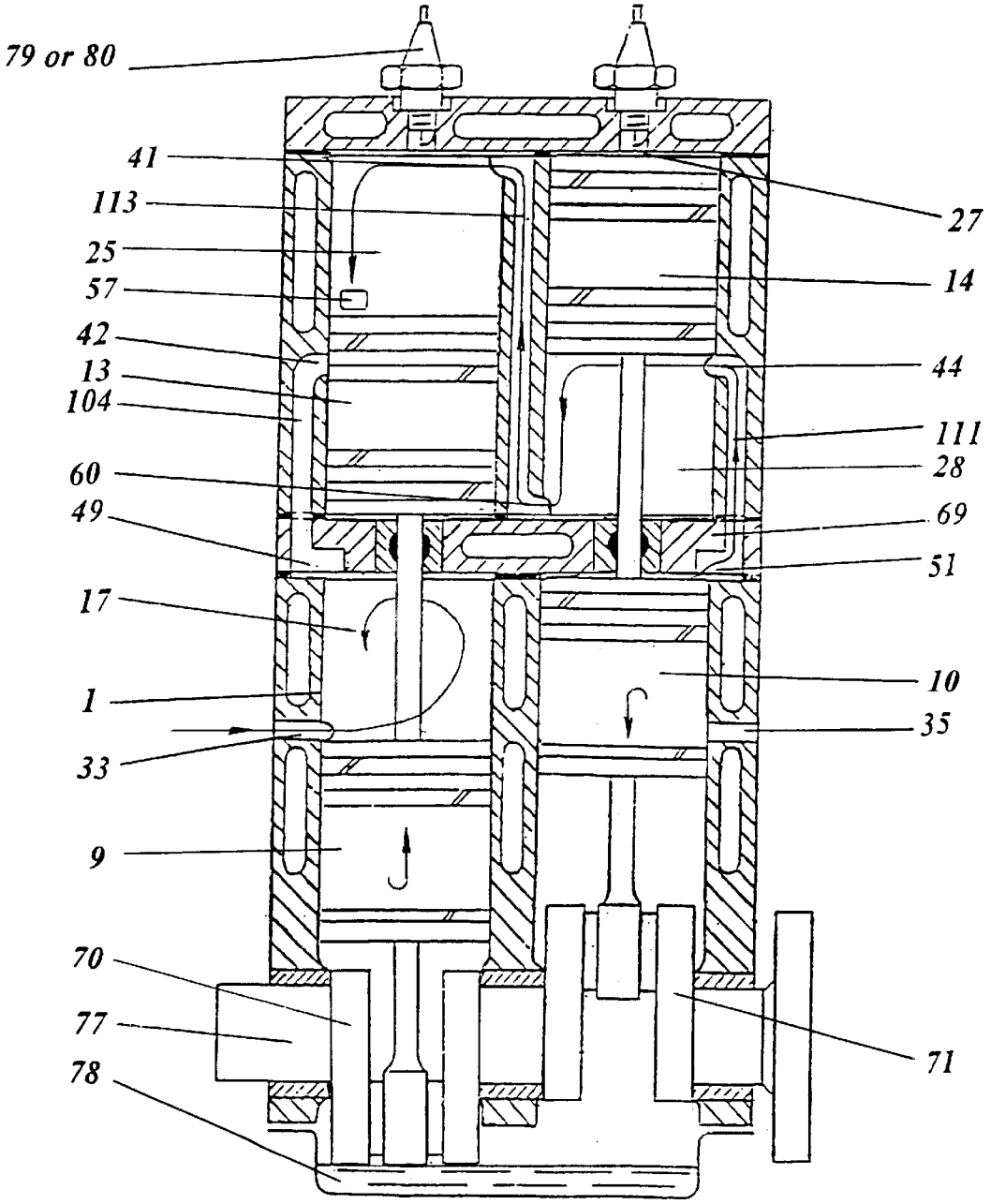
Figure 17:
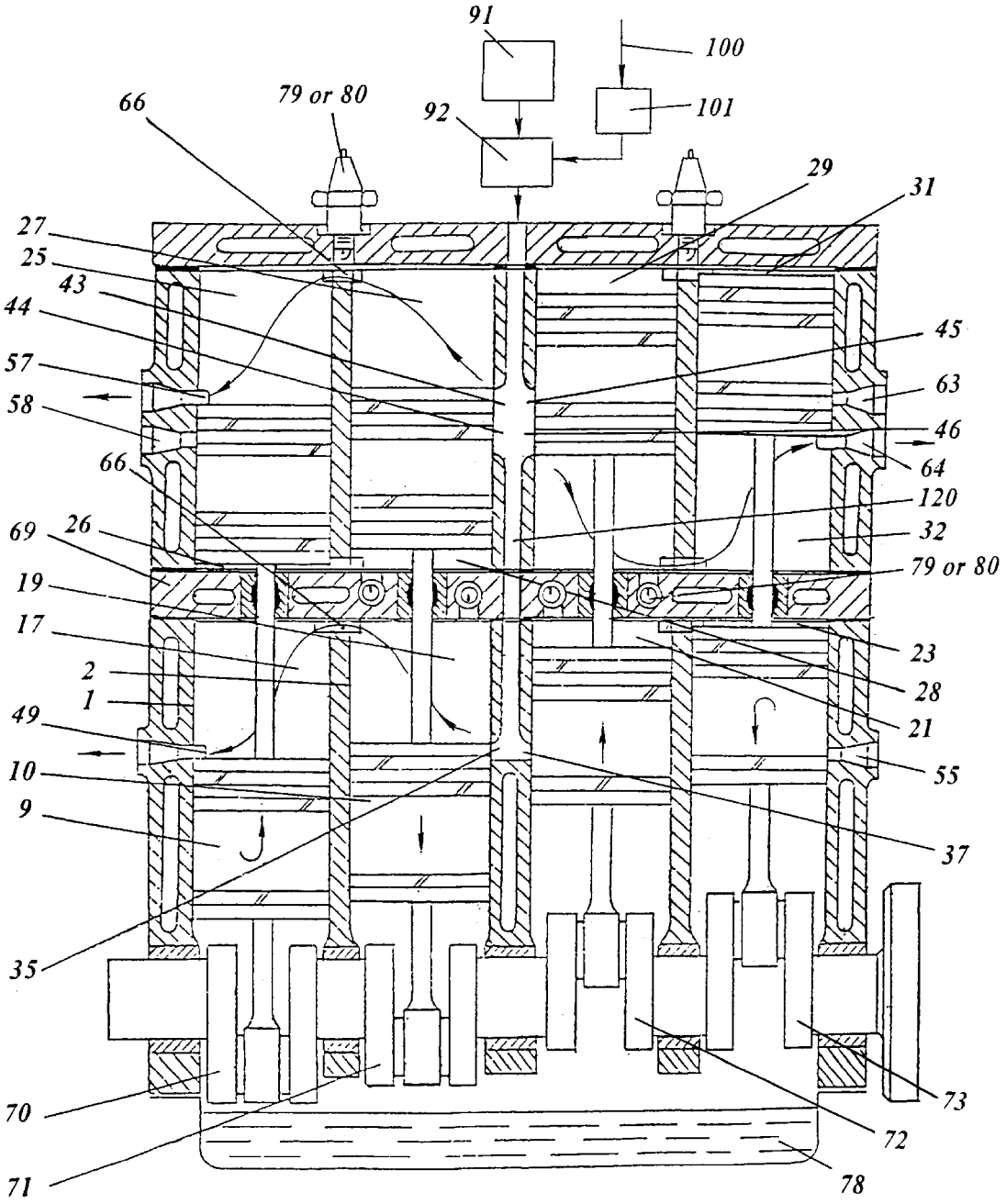
FIG. 17 shows four-row double-bank TSICE comprising four power cylinders in the first bank and four double-sided cylinders in the second bank, whose all cavities are power cavities, connected to external supercharger.
Figure 18:
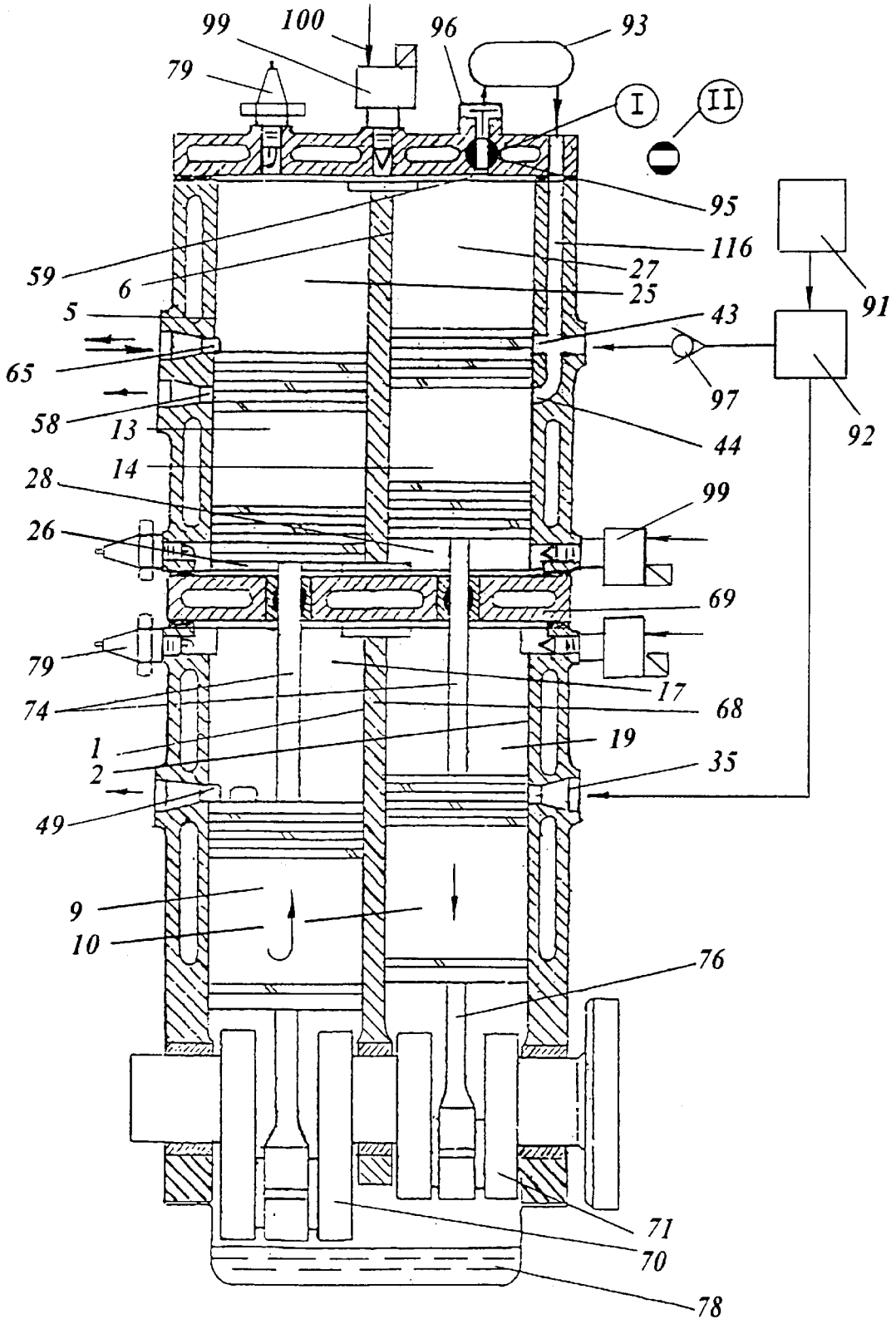
FIG. 18 shows double-row double-bank TSICE comprising two power cylinders in the first bank and two double-sided cylinders in the second bank, whose upper cavities are dual action cavities.
Figure 19:
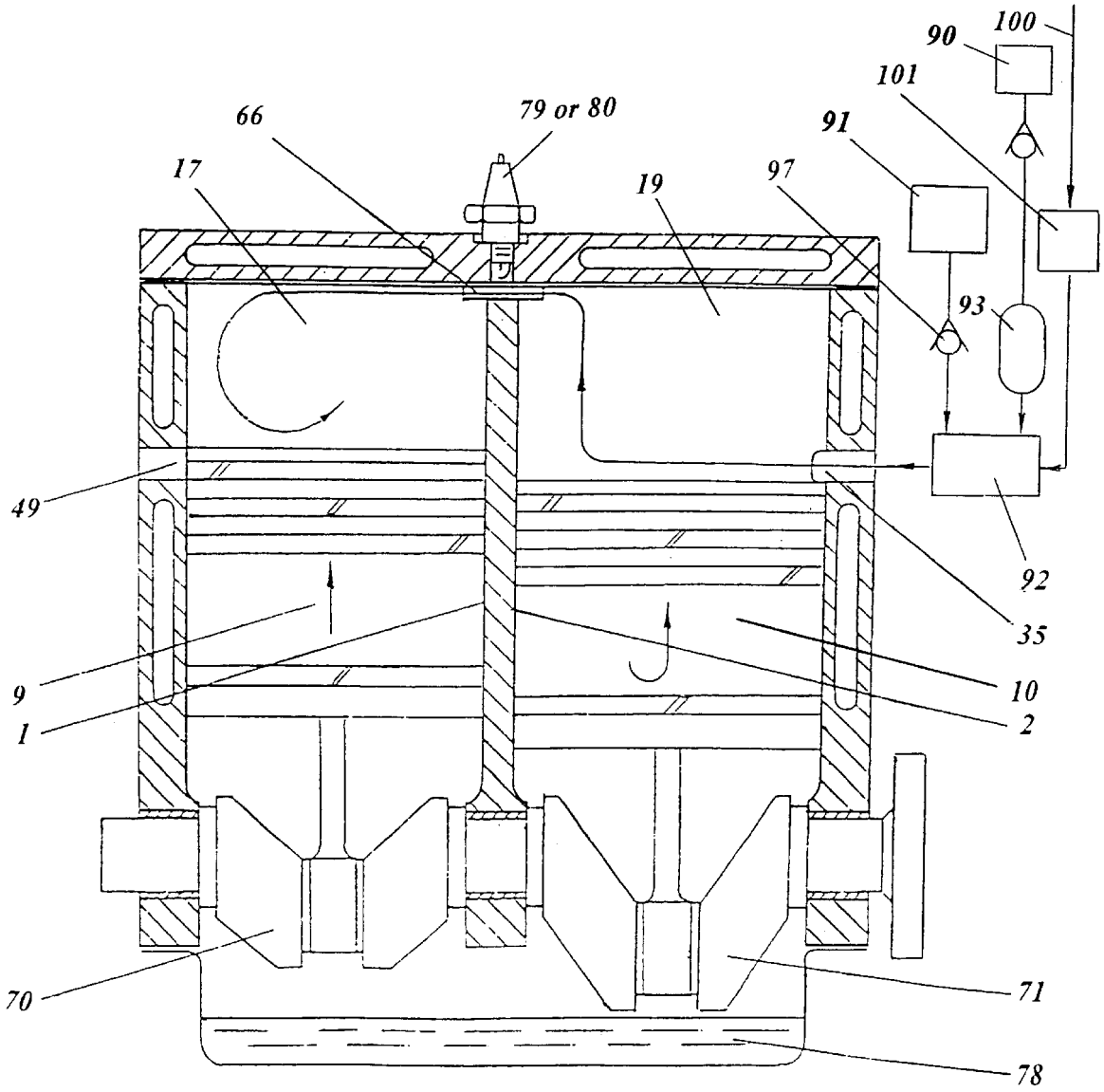
FIG. 19 shows TSICE comprising two power cylinders connected by a common combustion chamber and charged by two external superchargers.
Figure 20:
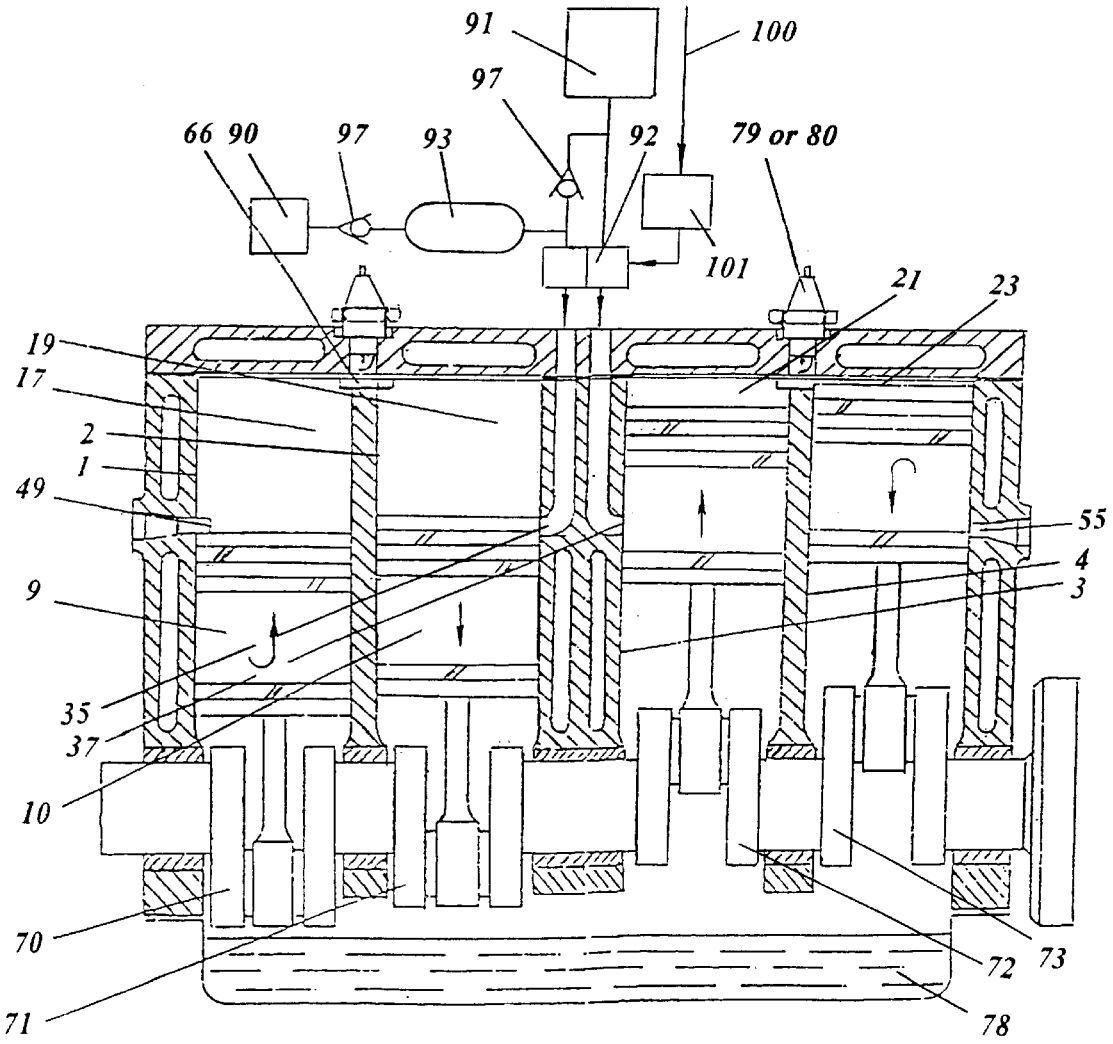
FIG. 20 shows TSICE comprising two pairs of power cylinders, each pair having a common combustion chamber, and charged by two external superchargers.

When the piston 9 reaches BDC at the end of power stroke, as shown on FIG. 10A, the exhaust port 49 opens, allowing the escape of burned gases from the cavities 17 and 20. During another β° of crankshaft rotation, both pistons move up: the piston 9 moves from BDC, closing the exhaust port 49, and the piston 10 moves towards TDC, opening the intake port 36. Until the exhaust port 49 is completely closed, the direct-flow scavenging/charging of the cavities 20 and 17 takes place. Pressurized air-fuel mixture from the supercharger 91 fills the cavities 20 and 17 through the intake port 36 and the channel 108, pushing the rest of the burned gases out of the exhaust port 49. The process of scavenging ends, when the piston 10 reaches TDC and the piston 9 closes the exhaust port 49 (FIG. 10B). The intake port 36 remains open and the process of charging of the power cylinders continues until the piston 10, moving down from TDC, closes the port 36 and a compression stroke begins in the cavities 17 and 20. At the time of scavenging/charging of the cavities 17 and 20, another pair of cavities, 18 and 19, is at the end of a compression stroke. When the piston 10 reaches TDC, the compressed air-fuel mixture in the cavities 18 and 19 is ignited, initiating in them a power stroke. This gas combustion causes the pistons 9 and 10 to move towards each other, piston 9 to TDC and piston 10 to BDC, compressing a new portion of air-fuel mixture in the cavities 17 and 20. When the piston 9 reaches TDC (FIG. 10C), the exhaust port 50 opens, allowing the release of the burned gases from the power cavities 18 and 19 through the channel 106 at the end of a combustion stroke. During another β° of crankshaft rotation, both pistons move down: the piston 9 moves from TDC, closing the exhaust port 50, and piston 10 moves towards BDC, opening the intake port 35. Until the exhaust port 50 is completely closed, the direct-flow scavenging/charging of the cavities 18 and 19 takes place. Pressurized air-fuel mixture from the supercharger 91 fills cavities 18 and 19 through the intake port 35 and channel 106, pushing the rest of the burned gases out of the exhaust port 50. The process of scavenging ends, when the piston 10 reaches BDC and the piston 9 closes the exhaust port 50 (FIG. 10D). The intake port 35 remains open and the process of charging of the power cylinders continues until the piston 10, moving up from BDC, closes the port 35 and a compression stroke begins in the cavities 18 and 19. At the time of scavenging/charging of the cavities 18 and 19, another pair of cavities, 17 and 20, is at the end of a compression stroke. When the piston 10 reaches BDC, a compressed air/fuel mixture in the cavities 17 and 20 is ignited, initiating in them a power stroke. This gas combustion causes the pistons 9 and 10 to move towards each other, the piston 9 to BDC and the piston 10 to TDC, compressing a new portion of air-fuel mixture in the cavities 18 and 19. When the piston 9 reaches BDC (FIG. 10A), the process continues, as described above.

All the engines, described above, achieve the object of increasing of power per liter of displacement.

The few shown examples illustrate, how wide can be the variety of applications of present invention, from small appliances, to the huge diesel marine engines.

Many more modifications of the present invention are possible, and among those, described above, TSICE, presented on FIG. 10, is considered as the preferred embodiment. Nevertheless, other shown embodiments may be given preference in different applications.

The scope of the invention should be determined by the appended claim, rather than by the examples given.

We claim:

1. A two stroke internal combustion engine comprising first power cylinder with a first piston reciprocally movable therein and an intake ports and second power cylinder with a second piston reciprocally movable therein and an exhaust ports, said pistons being connected each to its own crank, with the crank of the second piston having advanced crank angle against the crank of the first piston, enabling advanced opening and closing of the exhaust port in relation to the intake port, said cylinders being double-sided, with upper power cavities and lower power cavities on the opposite sides of the pistons, said cavities interconnected by passages in pairs, with lower power cavities separated from cranks by a transverse partition, and the intake ports of power cavities of the first cylinder connected to a source of scavenging and supercharging, with improvements, including said crank of the second piston having additional advancement of 180° against the crank of the first piston, providing movement of said pistons in opposition to each other, and said passages interconnecting lower power cavity of the first cylinder with upper power cavity of the second cylinder and upper power cavity of the first cylinder with lower power cavity of the second cylinder.

* * * * *